US005787978A

United States Patent [19]

Carter et al.

[11] Patent Number: 5,787,978

[45] Date of Patent: *Aug. 4, 1998

[54] MULTI-FACE WHIPSTOCK WITH SACRIFICIAL FACE ELEMENT

[75] Inventors: Thurman B. Carter, Houston; Paul J. Johantges, Deer Park; Charles W. Pleasants, Cypress, all of Tex.

[73] Assignee: Weatherford/Lamb, Inc.

[ * ] Notice: The term of this patent shall not extend beyond the expiration date of Pat. No. 5,620,051.

[21] Appl. No.: 752,359

[22] Filed: Nov. 19, 1996

Related U.S. Application Data

[60] Continuation-in-part of Ser. No. 655,087, Jun. 3, 1996, Pat. No. 5,620,051, which is a division of Ser. No. 414,338, Mar. 31, 1995, Pat. No. 5,522,461, and a continuation-in-part of Ser. No. 542,439, Oct. 12, 1995.

[51] Int. Cl.[6] ..... E21B 23/00

[52] U.S. Cl. ..... 166/117.6; 166/55.7

[58] Field of Search ..... 166/5, 55.1, 55.6, 166/55.7, 117.5, 117.6, 298

[56] References Cited

U.S. PATENT DOCUMENTS

| | | | |
|---|---|---|---|
| 1,524,265 | 1/1925 | Lester | 294/86.22 |
| 1,570,518 | 1/1926 | Mitchell | 166/117.5 |
| 1,636,032 | 7/1927 | Abbott . | |
| 1,951,638 | 3/1934 | Walker . | |
| 2,014,805 | 9/1935 | Hinderliter . | |
| 2,065,896 | 12/1936 | Keever | 175/83 |

(List continued on next page.)

OTHER PUBLICATIONS

"Coring Services," Weatherford, 1994.

"Casing Whipstocks," Eastman Whipstock, Composite Catalog 1976–1977, p. 2226.

"Product Catalog," Weatherford Petco, 1992, especially pp. 26–30.

"Bowen Whipstocks," Bowen Co., Composite Catalog, 1962–1963.

"Catalog 1958–59," Kinzbach Tool Co. Inc. 1958.

"Directional Drilling Tools," Homco Associated Oil Field Rentals, Composite Catalog 1964–1965, pp. 2391, 2392, 2394.

"Oilfield Services And Manufactured Products," Homco, 1984.

"A–Z Stub Type Whipstock," A–Z Int'l Tool Co., 1976–1977 Composite Catalog, p. 219.

"Weatherford Fishing and Rental Tool Services," Weatherford, 1993.

(List continued on next page.)

*Primary Examiner*—William P. Neuder
*Attorney, Agent, or Firm*—Guy McClung

[57] ABSTRACT

The present invention discloses, in certain preferred aspects, a whipstock with a body with a top, a bottom, and a cavity in the body, a sacrificial element secured to the top of the body, the sacrificial element having at least one surface for abutment by a first mill moving down adjacent the whipstock to guide the first mill while the first mill mills a tubular in which the whipstock is positioned and the sacrificial element for inhibiting the mill from contacting the body, the first mill having a curved outer shape and a nose projecting downwardly therefrom, the nose having a nose shape, the cavity defined by sides of the body and having filler material therein, the sides of the body presenting a face for abutment by a second mill while the second mill moves down adjacent the whipstock to mill a window in the tubular, the face for guiding the second mill and inhibiting the second mill from contacting the body other than the sides thereof defining the cavity, the sacrificial element having a groove therein with a groove shape corresponding to the nose shape of the nose of the first mill, the sacrificial element made of readily millable material, the at least one surface of the sacrificial element for abutment by the first mill, the at least one surface including a curved surface having a curved shape corresponding to a curved outer shape of the first mill to enhance guiding contact between the first mill and the curved surface.

20 Claims, 19 Drawing Sheets

U.S. PATENT DOCUMENTS

| | | | |
|---|---|---|---|
| 2,103,622 | 12/1937 | Kinzbach . | |
| 2,105,721 | 1/1938 | Cutrer et al. . | |
| 2,105,722 | 1/1938 | Barrett et al. . | |
| 2,158,329 | 5/1939 | Kinzback . | |
| 2,196,517 | 4/1940 | Bolton . | |
| 2,216,963 | 10/1940 | Sinclair | 175/82 |
| 2,281,414 | 4/1942 | Clark . | |
| 2,331,293 | 10/1943 | Ballard . | |
| 2,362,529 | 11/1944 | Barrett et al. | 166/117.6 X |
| 2,386,514 | 10/1945 | Stokes | 175/81 |
| 2,401,893 | 6/1946 | Williams, Jr. | 175/81 |
| 2,553,874 | 5/1951 | Spaulding et al. . | |
| 2,766,010 | 10/1956 | Hester | 166/217 |
| 2,770,444 | 11/1956 | Neal . | |
| 2,807,440 | 9/1957 | Beck . | |
| 2,882,015 | 4/1959 | Beck . | |
| 2,885,182 | 5/1959 | Hering | 255/1.6 |
| 2,978,032 | 4/1961 | Hanna | 166/117.5 |
| 3,095,039 | 6/1963 | Kinzback | 166/117.6 |
| 3,172,488 | 3/1965 | Roxstrom . | |
| 3,570,598 | 3/1971 | Johnson | 166/178 |
| 3,732,924 | 5/1973 | Chelette et al. | 166/55 |
| 3,908,759 | 9/1975 | Cagle et al. | 166/117.6 |
| 4,043,390 | 8/1977 | Glotin | 166/215 |
| 4,182,423 | 1/1980 | Ziebarth et al. | 175/61 |
| 4,266,621 | 5/1981 | Brock | 175/329 |
| 4,397,355 | 8/1983 | McLamore | 166/297 |
| 4,415,205 | 11/1983 | Rehm et al. | 299/5 |
| 4,420,049 | 12/1983 | Holbert | 175/45 |
| 4,733,732 | 3/1988 | Lynch | 175/9 |
| 4,796,709 | 1/1989 | Lynde et al. | 166/55.6 |
| 4,807,704 | 2/1989 | Hsu et al. | 166/313 |
| 4,848,462 | 7/1989 | Allwin | 166/208 |
| 4,887,668 | 12/1989 | Lynde et al. | 166/55.8 |
| 4,938,291 | 7/1990 | Lynde et al. | 166/55.8 |
| 4,978,260 | 12/1990 | Lynde et al. | 166/55.6 |
| 4,984,488 | 1/1991 | Lunde et al. | 166/55.6 |
| 5,010,955 | 4/1991 | Springer | 166/298 |
| 5,014,778 | 5/1991 | Lynde et al. | 166/55.6 |
| 5,035,292 | 7/1991 | Bailey et al. | 175/45 |
| 5,038,859 | 8/1991 | Lynde et al. | 166/55.6 |
| 5,058,666 | 10/1991 | Lynde et al. | 166/55.6 |
| 5,086,838 | 2/1992 | Cassel et al. | 166/55.6 |
| 5,109,924 | 5/1992 | Jurgens et al. | 166/117.5 |
| 5,150,755 | 9/1992 | Cassel et al. | 166/297 |
| 5,199,513 | 4/1993 | Stewart et al. | 175/73 |
| 5,297,630 | 3/1994 | Lynde et al. | 166/297 |
| 5,335,737 | 8/1994 | Baugh | 175/61 |
| 5,373,900 | 12/1994 | Lynde et al. | 166/297 |
| 5,379,845 | 1/1995 | Blount et al. | 166/382 |
| 5,392,858 | 2/1995 | Peters et al. | 166/298 |
| 5,398,754 | 3/1995 | Dinhoble | 166/117.6 |
| 5,425,417 | 6/1995 | Carter | 166/117.6 |
| 5,425,419 | 6/1995 | Sieber | 166/206 |
| 5,427,179 | 6/1995 | Bailey et al. | 166/117.6 |
| 5,429,187 | 7/1995 | Beagrie et al. . | |
| 5,431,220 | 7/1995 | Lennon et al. | 166/55.7 |
| 5,437,340 | 8/1995 | Lee et al. | 175/61 |
| 5,443,129 | 8/1995 | Bailey et al. | 175/45 |
| 5,445,222 | 8/1995 | Pritchard et al. | 116/117.6 |
| 5,452,759 | 9/1995 | Carter et al. | 166/117.6 |
| 5,456,312 | 10/1995 | Lynde et al. | 166/55.6 |
| 5,462,120 | 10/1995 | Gondouin | 166/117.6 |
| 5,467,820 | 11/1995 | Sieber | 166/117.6 |
| 5,474,126 | 12/1995 | Lynde et al. | 166/117.6 |
| 5,484,021 | 1/1996 | Hailey | 166/297 |
| 5,499,680 | 3/1996 | Walter et al. | 166/377 |
| 5,544,704 | 8/1996 | Laurel et al. | 166/117.6 |
| 5,551,509 | 9/1996 | Braddick | 166/55.7 |
| 5,564,503 | 10/1996 | Longbottom et al. | 166/313 |
| 5,566,762 | 10/1996 | Braddick et al. | 166/382 |
| 5,566,763 | 10/1996 | Williamson et al. | 166/382 |
| 5,573,064 | 11/1996 | Hisaw | 166/250.07 |
| 5,595,247 | 1/1997 | Braddick | 166/297 |
| 5,620,051 | 4/1997 | Carter et al. | 166/298 |
| 5,647,436 | 7/1997 | Braddick | 166/298 |
| 5,647,437 | 7/1997 | Braddick et al. | 166/382 |

OTHER PUBLICATIONS

"Improved Casing Sidetrack Procedure Now Cuts Wider, Longer Windows," Cagle et al, Petroleum Engr. Int'l, Mar. 1979.

"Dual Horizontal extension drilled using retrievable whipstock," Cress et al, World Oil, Jun. 1993.

"1990–91 General Catalog," A–1 Bit & Tool Co., p. 9, 1990.

"TIW's SS–WS Whipstock Pakcer," Texas Iron Works, p. 111.9.18; 1986.

FIG. 2C
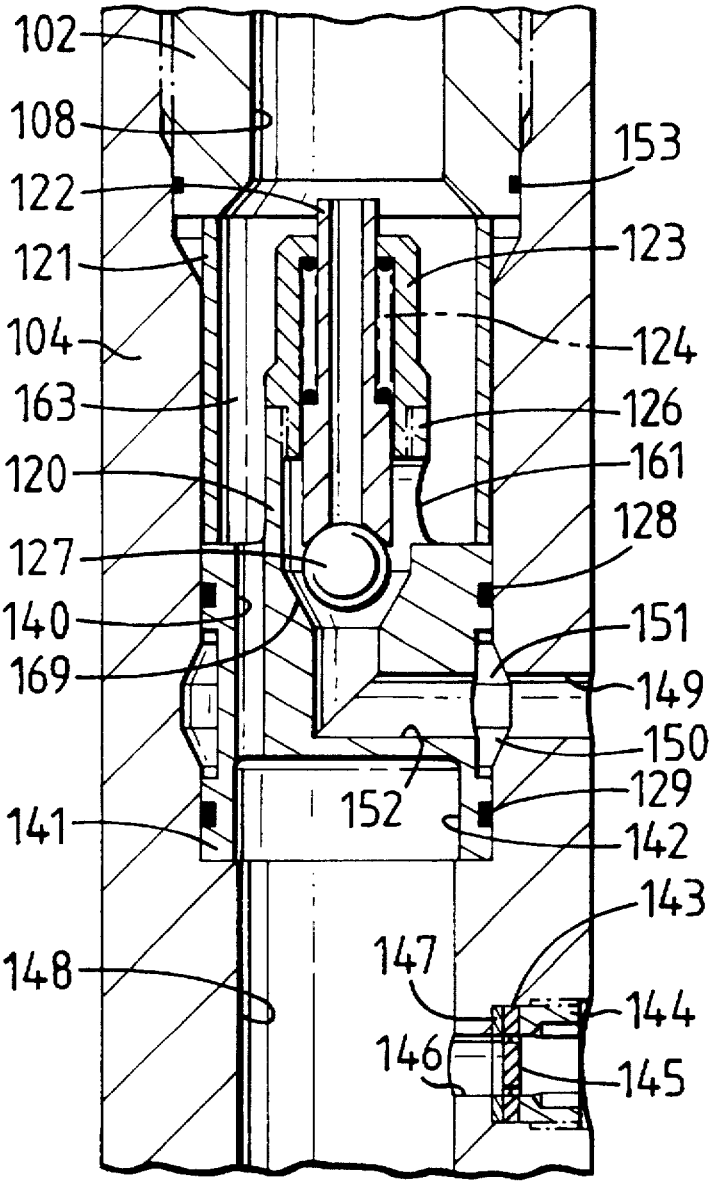
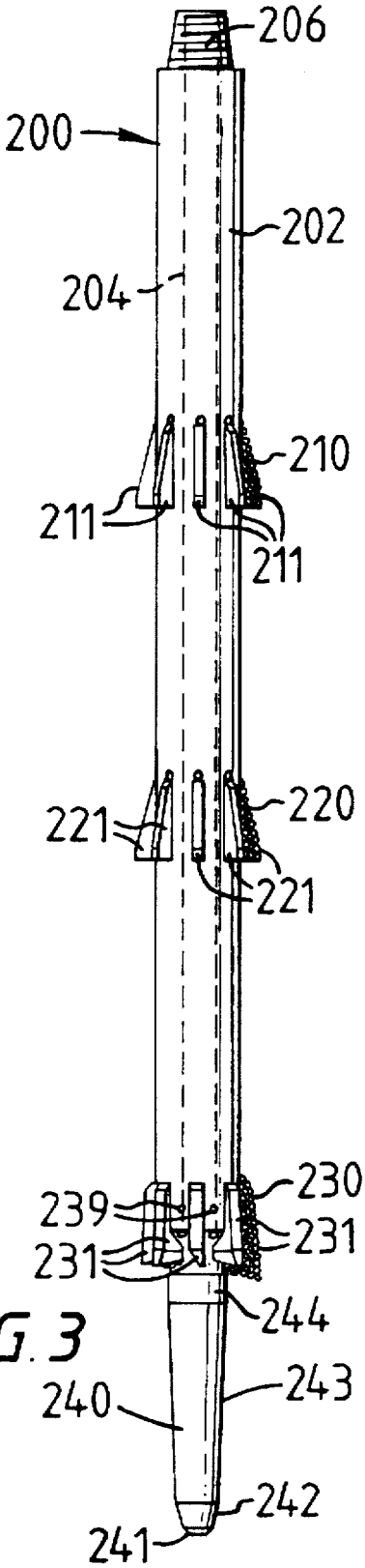
FIG. 3

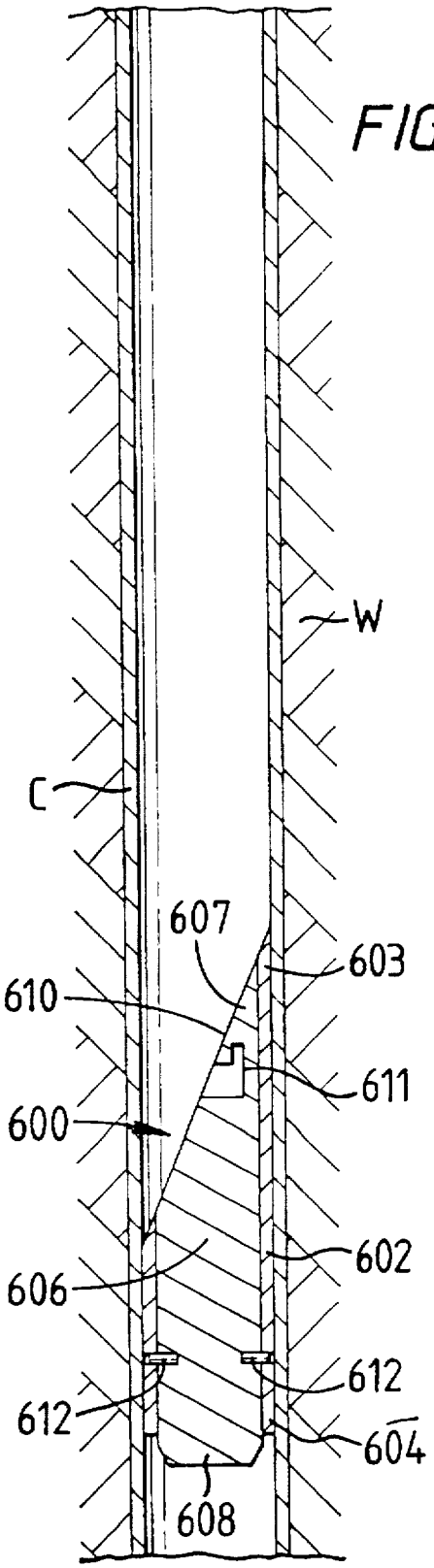
FIG. 18A
FIG. 18B
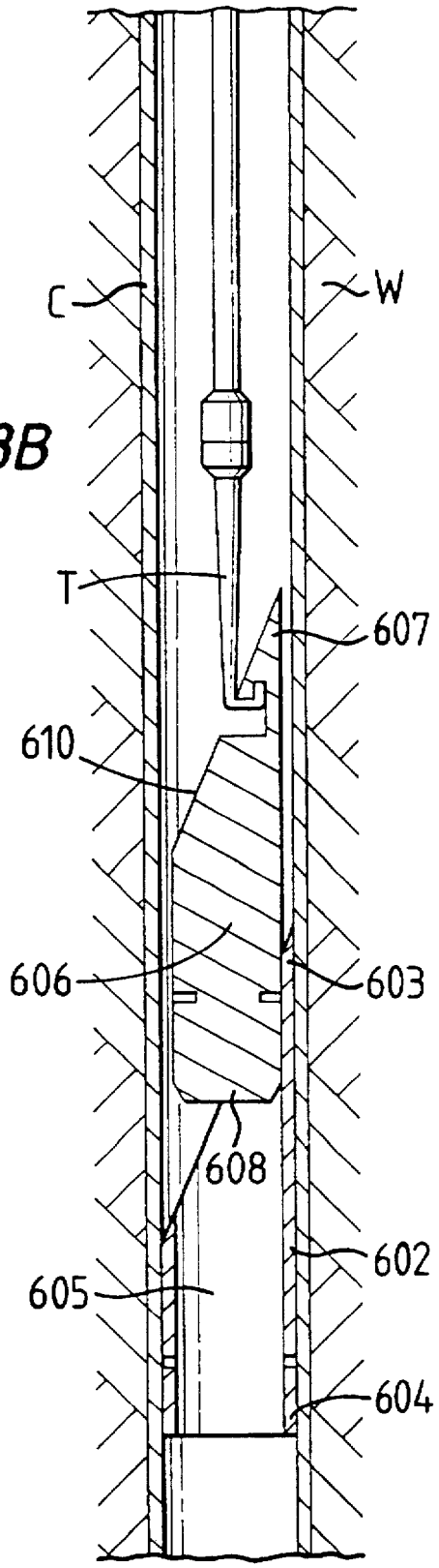

MULTI-FACE WHIPSTOCK WITH SACRIFICIAL FACE ELEMENT

RELATED APPLICATIONS

This is a continuation-in-part of pending U.S. application Ser. No. 08/655,087 filed Jun. 3, 1996 now U.S. Pat. No. 5,260,051 entitled "Whipstock" which is a division of U.S. application Ser. No. 08/414,338 filed Mar. 31, 1995 entitled "Mill Valve" issued as U.S. Pat. No. 5,522,461 on Jun. 4, 1996, and a continuation-in-part of U.S. application Ser. No. 08/542,439 filed Oct. 12, 1995 entitled "Starting Mill and Operations," these three applications co-owned with the present invention and incorporated herein in their entirety for all purposes.

BACKGROUND OF THE INVENTION

1. Field of the Invention

This invention is related to wellbore milling systems and methods, downhole mills, running tools useful in such systems and methods, whipstocks useful in such systems and methods, in one aspect to a multi-face whipstock and in one aspect to such a whipstock with a faced sacrificial element for sacrificially directing a mill.

2. Description of Related Art

Milling tools are used to cut out windows or pockets from a tubular, e.g. for directional drilling and sidetracking; and to remove materials downhole in a well bore, such as pipe, casing, casing liners, tubing, or jammed tools or portions thereof. The prior art discloses various types of milling or cutting tools provided for cutting or milling existing pipe or casing previously installed in a well. These tools have cutting blades or surfaces and are lowered into the well or casing and then rotated in a cutting operation. With certain tools, a suitable drilling fluid is pumped down a central bore of a tool for discharge beneath the cutting blades and an upward flow of the discharged fluid in the annulus outside the tool removes from the well cuttings or chips resulting from the cutting operation.

Milling tools have been used for removing a section of existing casing from a well bore to permit a sidetracking operation in directional drilling, to provide a perforated production zone at a desired level, to provide cement bonding between a small diameter casing and the adjacent formation, or to remove a loose joint of surface pipe. Also, milling tools are used for milling or reaming collapsed casing, for removing burrs or other imperfections from windows in the casing system, for placing whipstocks in directional drilling, or for aiding in correcting dented or mashed-in areas of casing or the like. Prior art sidetracking methods use cutting tools of the type having cutting blades and use a deflector such as a whipstock to cause the tool to be moved laterally while it is being moved downwardly in the well during rotation of the tool to cut an elongated opening pocket, or window in the well casing.

Certain prior art well sidetracking operations employ a whipstock and a variety of milling tools used in sequence. For example, in one typical operation, a packer is set in a wellbore at a desired location and acts as an anchor against which tools above it may be urged to activate different tool functions. The packer typically has a key or other orientation indicating member. The packer's orientation is checked by running a tool such as a gyroscope indicator into the wellbore. A whipstock-mill combination tool is then run into the wellbore and a stinger at the bottom of the tool is oriented with respect to a concave face of the tool's whipstock. Splined connections between a stinger and the tool body facilitate correct stinger orientation. A starting mill is secured at the top of the whipstock, e.g. with a setting stud and nut. The tool is then lowered into the wellbore so that the packer engages the stinger and the tool is oriented. Slips extend from the stinger and engage the side of the wellbore to prevent movement of the tool in the wellbore. Pulling on the tool then shears the setting stud, freeing the starting mill from the tool. Rotation of the string with the starting mill rotates the mill. The starting mill has a tapered portion which is slowly lowered to contact a pilot lug on the concave face of the whipstock. This forces the starting mill into the casing to mill the pilot lug or portion there of and cut an initial window in the casing. The starting mill is then removed from the wellbore. A window mill, e.g. on a flexible joint of drill pipe, is lowered into the wellbore and rotated to mill down from the initial window formed by the starting mill. Typically then a window mill with a watermelon mill mills all the way down the concave face of the whipstock forming a desired cut-out window in the casing. This may take multiple trips. Then, the used window mill is removed and a new window mill and string mill and a watermelon mill are run into the wellbore with a drill collar (for rigidity) on top of the watermelon mill to lengthen and straighten out the initial window in the casing and smooth out the window-casing-open-hole transition area. The tool is then removed from the wellbore.

Prior milling methods, including but not limited to using a mill on coiled tubing, present a variety of problems.

Milling into a concave or milling down too far on a concave member of a whipstock damages the concave and may not result in the milling of a desired initial window or completed window.

There has long been a need for an efficient and effective milling method in which milling of and damage to a whipstock is reduced or eliminated. There has long been a need for tools useful in such methods. There has long been a need for a whipstock through which a load may be transmitted without shearing a shearable member connecting another tool to the whipstock. There has long been a need for a whipstock with a hollow portion filled with a filler parts of which are not inadvertently expelled from the whipstock. There has long been a need for a mill system which effectively co-acts with a face or faces on a whipstock to produce a desired window in an adjacent tubular member.

SUMMARY OF THE PRESENT INVENTION

The present invention, in one embodiment, discloses a whipstock system for milling a window in a tubular with which a milling system does not contact a hollow whipstock body until an initial window is made.

In one embodiment a whipstock according to the present invention has one or more millable members on its concave portion to inhibit or prevent milling of the concave itself rather than the tubular portion to be milled. The millable member(s) also provides a surface abutting the mill and forcing the mill against the tubular to be milled. In one embodiment, the millable member(s) is made of a suitable bearing material, e.g. but not limited to brass, to ease and facilitate mill rotation, particularly in those embodiments in which relatively low mill torque is developed. In one aspect the millable member(s) extend to a point below the level at which contacting the contact member stops the mill; thus preventing the mill from milling past the millable member(s) into the concave main body. It is within the scope of this invention to employ one continuous millable member disposed along the concave face or to use a series of spaced apart members which are sized, disposed, and configured so that the mill is always in contact with at least one of them and is forced against the tubular to be milled by one of them, yet the mill is not continuously required to mill a millable member in addition to milling the tubular to be milled.

The present invention, in one embodiment, discloses a mill with a main body having a central bore therethrough. Different portions of the bore are sized and configured to accommodate different parts of the mill. In one aspect the mill is a starting mill. In another aspect the mill is a window mill or a starting mill/window mill combination.

A top sub is connected to a top end of the main body to facilitate interconnection of the starting mill with a drill string, MWD assembly, jar, stabilizer, or other item. A lower end of the main body has a hole therethrough through which passes a shear stud or bolt for releasably connecting the starting mill to a pilot lug of an upper concave portion of a whipstock. In certain preferred embodiments the lower end of the main body has a series of ratcheting teeth which co-act with corresponding teeth on the pilot lug of the concave so that downward force on the starting mill is transferred to the concave without affecting the shear stud; but an upward force on the starting mill is transferred to the shear stud since the teeth on the starting mill are profiled to slide past the correspondingly profiled teeth on the pilot lug. Thus the shear stud is isolated from downward forces on the starting mill which prevents the shear stud from being sheared, e.g. when a downward force is applied to a whipstock-and-anchor-packer combination to check that the packer is set and to pivot the concave against the casing wall.

In certain embodiments the present invention discloses a whipstock with a body with a top and a bottom and a concave portion, the concave having a hollow portion filled with filler material, and sacrificial apparatus for guiding a mill moving down with respect to the top of the body, the sacrificial apparatus having at least one face against which a mill is movable, the sacrificial apparatus disposed for milling by the mill moving adjacent the concave portion to inhibit the mill from milling the body; such a whipstock with a top of the body extending from the body above the sacrificial apparatus, a shearable member releasably connecting an upper device to the top of the body, and load isolation apparatus on the top of the body for isolating from the shearable member a load impressed through the upper device on the whipstock; any such whipstock wherein the sacrificial apparatus has a length such that the mill mills an initial window through a tubular in which the whipstock is disposed; any such whipstock in which the load isolation apparatus includes the top of the body having body teeth thereon for engagement by corresponding device teeth on the upper device, the body teeth configured to transmit a downward load on the whipstock transmitted through the upper device, and the body teeth configured to slide away from the device teeth when the upper device is pulled upwardly away from the whipstock thereby shearing the shearable member.

In certain aspects a whipstock according to the present invention has a body with a top, a bottom, and a hollow concave, the hollow concave having a cavity therein filled with filler material, and a plug in the bottom of the body for maintaining the filler material in the cavity of the hollow concave; such a whipstock wherein the plug is made of readily millable material; such a whipstock wherein a fluid flow channel extends through the filler material so that fluid is flowable through the whipstock, and valve apparatus in the fluid flow channel for selectively controlling fluid flow through the whipstock; such a whipstock wherein the valve apparatus is selectively opened as the whipstock is moved down into a wellbore so fluid in the wellbore may pass through the whipstock negating buoyancy thereof; any such whipstock wherein the body has a central longitudinal axis and the plug is off-center with respect to said axis; any such whipstock with positioning apparatus connected to the plug for positioning the plug in the cavity, and the plug having portions extending into the cavity having ramps so that upon milling of the plug remainders of the plug remaining in the cavity projecting thereinto present an inclined surface to an item thereafter passing through the cavity to facilitate the items passage therethrough.

In other aspects the present invention discloses a whipstock with a body with a top, a bottom, and a cavity in the body, a sacrificial element secured to the top of the body, the sacrificial element having at least one surface for abutment by a first mill moving down adjacent the whipstock to guide the first mill while the first mill mills a tubular in which the whipstock is positioned and the sacrificial element for inhibiting the mill from contacting the body, the cavity defined by sides of the body and having filler material therein, the sides of the body presenting a face for abutment by a second mill while the second mill moves down adjacent the whipstock to mill a window in the tubular, the face for guiding the second mill and inhibiting the second mill from contacting the body other than the sides thereof defining the cavity; such a whipstock with the surface of the sacrificial element having a length such that the first mill moving down the surface mills through a tubular in which the whipstock is positioned while the first mill maintains contact with the surface; such a whipstock wherein the first mill has a nose projecting downwardly therefrom, the nose having a nose shape and the sacrificial element having a groove therein with a groove shape corresponding to the nose shape of the nose of the first mill; such a whipstock wherein the sacrificial element is made of readily millable material; such a whipstock wherein the sacrificial element has a length such that the mill mills an initial window through a tubular in which the whipstock is disposed, the window at least three feet long; such a whipstock wherein a top of the body extends from the body above the sacrificial element, a shearable member releasably connects an upper device to the top of the body, and load isolation apparatus on the top of the body isolates from the shearable member a load impressed through the upper device on the whipstock; such a whipstock wherein the at least one surface for abutment by a first mill of the sacrificial element includes a curved surface having a curved shape corresponding to a curved outer shape of the first mill to enhance guiding contact between the first mill and the curved surface; such a whipstock wherein the sacrificial element has a length such that a remaining portion thereof remains following production of an initial window by the first mill through the tubular, the remaining portion projecting sufficiently from the whipstock body to act as a stop member for the second mill; such a whipstock with a plug in the bottom of the body for maintaining the filler material in the cavity, the plug made of readily millable material, a fluid flow channel extending through the filler material so that fluid is flowable through the whipstock, and the plug including valve apparatus in the fluid flow channel for selectively controlling fluid flow through the whipstock. In certain aspects the present invention discloses a whipstock with a body with a top, a bottom, and a cavity in the body, a sacrificial element secured to the top of the body, the sacrificial element having at least one surface for abutment by a first mill moving down adjacent the whipstock to guide the first mill while the first mill mills a tubular in which the whipstock is positioned and the sacrificial element for inhibiting the mill from contacting the body, the first mill having a curved outer shape and a nose projecting downwardly therefrom, the nose having a nose shape, the cavity defined by sides of the body and having filler material therein, the sides of the body presenting a face for abutment by a second mill while the second mill moves down adjacent the whipstock to mill a window in the tubular, the face for guiding the second mill and inhibiting the second mill from contacting the body other than the sides thereof defining the cavity, the sacrificial element having a groove therein with a groove shape corresponding to the nose shape of the nose of the first mill, the sacrificial element made of readily millable material, the at least one surface of the sacrificial element for abutment by the first mill, the at least one surface including a curved surface having a curved shape corresponding to a curved outer shape of the first mill to enhance guiding contact between the first mill and the curved surface.

It is, therefore, an object of at least certain preferred embodiments of the present invention to provide: new, useful, unique, efficient, nonobvious wellbore mills and milling methods.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

FIGS. 2B and 2C show enlarged portions of the apparatus of FIG. 2A.

FIG. 3 is a side view of a mill system according to the present invention.

FIGS. 18A and 18B are side views in cross-section of a system according to the present invention.

DESCRIPTION OF EMBODIMENTS PREFERRED AT THE TIME OF FILING FOR THIS PATENT

Figure 1A:
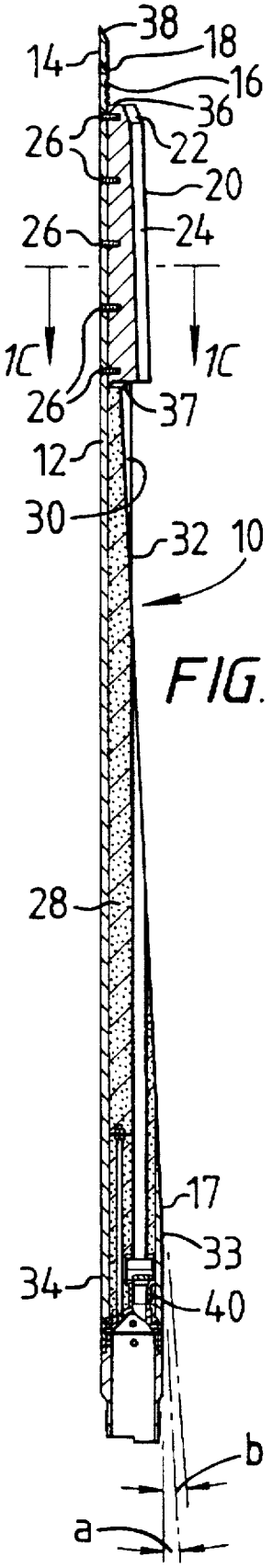
FIG. 1A is a side view in crosssection of a system according to the present invention.

FIG. 1A shows a system 10 according to the present invention having a whipstock body 12, a sacrificial element 20 with two guiding faces secured to the whipstock body 12 with bolts 26, filler 28 in a recess 30 of the body 12, and a plug element 40 in a bottom 34 of the whipstock body 12.

Figure 2A:
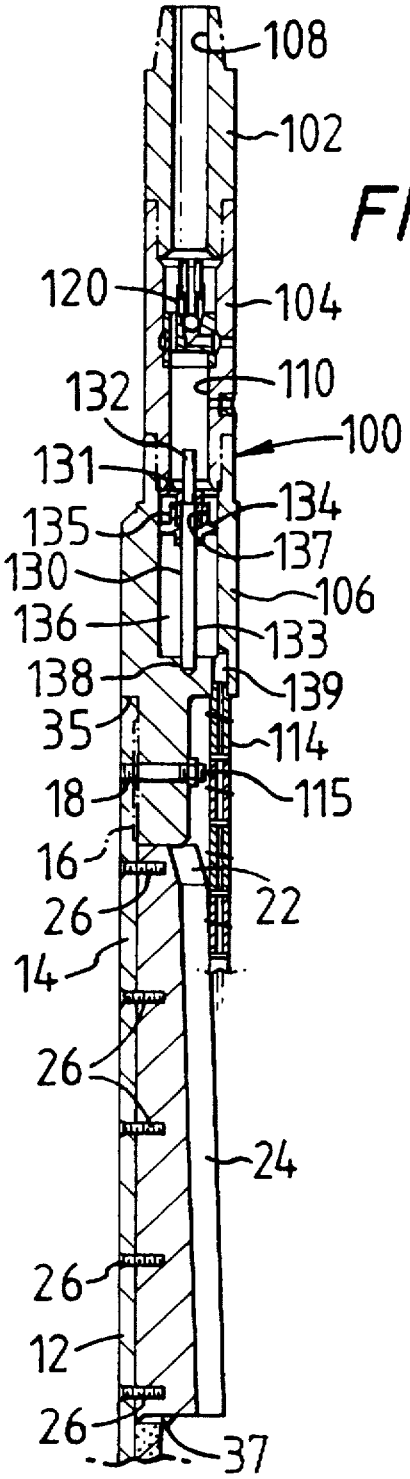
FIG. 2A is a side view in cross-section of part of the whipstock system of FIG. 1A with a running tool attached at a top thereof.
Figure 2B:
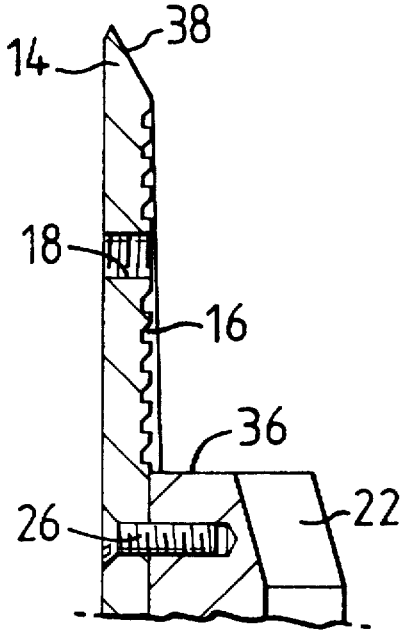

A top 14 of the whipstock body 12 extends above the sacrificial element 20 (preferably made of readily millable material, e.g. brass, bronze, composite material, iron, cast iron, typical relatively soft bearing materials, soft steels, fiberglass, aluminum, zinc, other suitable metals, or alloys or combinations thereof) and has a sloped ramp 38 (or a top shoulder 35 as shown in FIG. 2A). One-way teeth 16 are formed in the top 14 so that a member (not shown in FIG. 1A) with corresponding teeth may push down on the whipstock body 12 so that exerted force is transmitted from the corresponding teeth of the member to the whipstock body 12 and so that the teeth 16 and the corresponding teeth on the member slide apart when pulling up on the member with sufficient force. A hole 18 provides an opening for receiving a connector to connect the member to the whipstock body 12.

The first face 22 of the sacrificial element 20 is slanted so that a mill with an appropriate corresponding ramped portion contacts the first face 22 and is directed away from the whipstock body 12 (at an angle of between 50° to 250° and in one aspect about 15° from the central longitudinal axis of the body) e.g. to commence milling of a tubular (not shown), e.g. casing or tubing, in which the system 10 is anchored. Any suitable known anchor device may be used. The second face 24 is configured, sized and disposed for further direction of a mill away from the whipstock body 12 as it mills the tubular.

In one aspect as a mill moves down against the sacrificial element 20, it mills a portion of the sacrificial element 20 rather than milling the whipstock body 12. A third face 32 includes sides or "rails" 12*a*, 12*b* (see Figs. IC, 10, and 5A) of the whipstock body 12 which are sufficiently wide and strong to guide a mill moving downwardly adjacent the whipstock. A fourth face 33 extends below the third face 32. In one aspect the fourth face 33 is straight and the third face 32 is a chord of a circle. The first, second, third, and fourth faces may each be straight or curved (e.g. a chord of a circle) as desired and either inclined at any desired angle in a straight line away from a longitudinal axis of the body or curved as a chord of any desired circle.

Figure 1B:
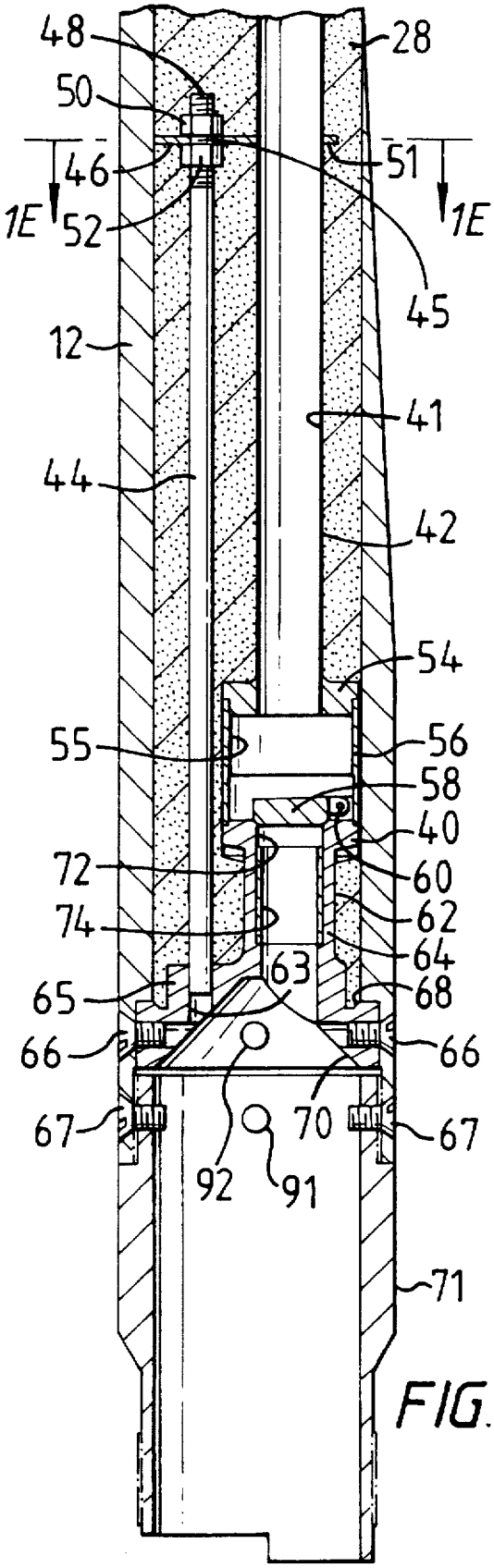
FIG. 1B is an enlargement of part of the system of FIG. 1A.
Figure 1D:
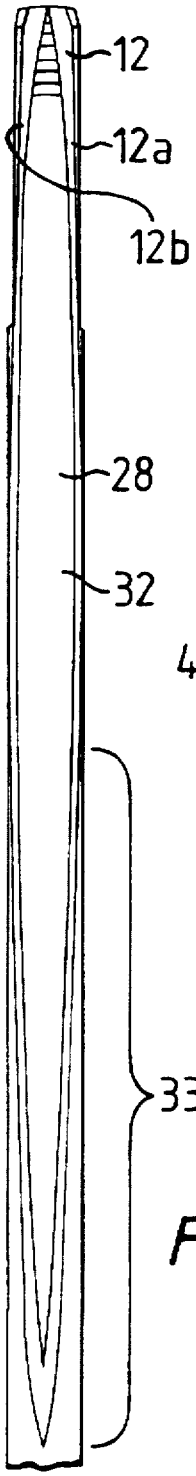
FIG. 1D is a front view of part of the system of FIG. 1A.

The plug element 40 is secured in the bottom 34 of the whipstock body 12. The plug element 40 retains the filler 28 within the recess 32. Via a channel 41 through a tube 42 (e.g. made of readily millable material), a channel 55 through a valve body 56 (e.g. made of readily millable material), a channel 72 through a body 62, and a sleeve 74 in a body 64, fluid flow through the plug element 40 is possible when a valve member 58 rotates upwardly about a pivot 60. As shown in FIG. 1B the valve member 58 is closing off fluid flow from above the plug element 40 to beneath it, either due to the fact that there is little or no fluid flow and gravity holds the valve member 58 down or the force of fluid flow from below into the channel 72 is insufficient to overcome the weight of fluid on top of the valve member 58. Epoxy or some other suitable adhesive may be used to hold the body 62, body 64, and sleeve 74 together.

Figure 1C:
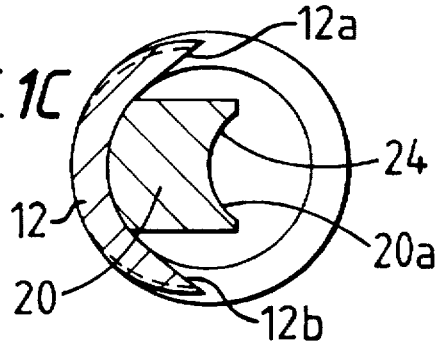
FIG. 1C is a cross-section view along line 1C—1C of FIG. 1A.

As shown in FIG. 1C, in one aspect a surface 20*a* of the sacrificial element 20 is shaped and configured as part of a curve to correspond to a curved outer shape of a nose of a mill to facilitate milling and guide a mill moving down the sacrificial element. E.g., a mill 200 described below has a nose 240 with a cylindrical portion 244 that matches the curve of the surface 20*a* and a tapered portion 243 is also sized and configured to co-act effectively with the surface 20*a*. These corresponding curved shapes make possible line contact rather than point contact between the mill and the surface 20*a* so that enhanced guiding of the mill is achieved.

Preferably the plug element 40 is off center with respect to a central longitudinal axis from top to bottom of the whipstock body 12 to facilitate eventual milling out of the filler 28 and of the plug element 40 from the recess 30.

Figure 1E:
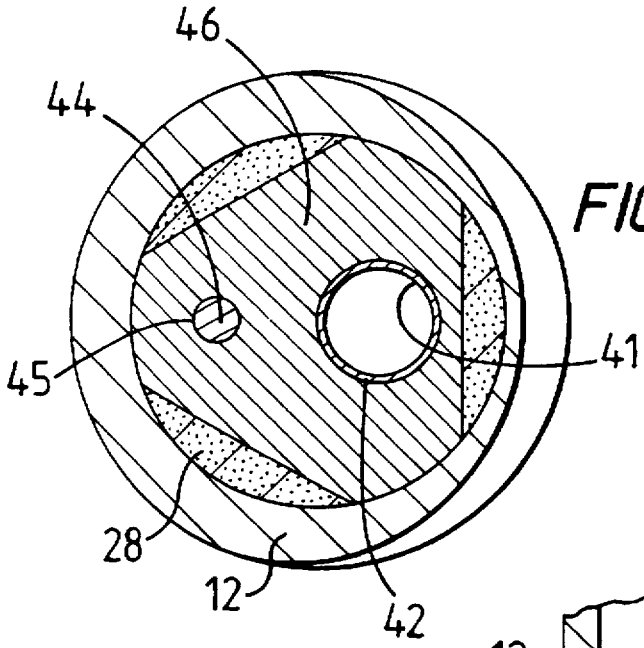
FIG. 1E is a cross-section view along line 1E—1E of FIG. 1B.

To insure proper positioning of the plug element 40 upon installation in the recess 30 and to hold the plug element 40 in position as filler 28 is fed into the recess 30, a rod 44 (e.g. made of readily millable material) is secured at its bottom end in a hole 63 in a part 65 of the body 64 and at its top end 48 by nuts 50 and 52 in a hole 45 in a locating plate 46 which itself is secured in place by hardened filler 28 (see FIG. 1E). The tube 42 passes through a hole 51 in the locating plate 46.

Bolts 66 (e.g. readily millable material) hold a part 65 of the body 64 in place. Bolts 66 also connect an adapter 71 to the whipstock body 12. The adapter 71 is connected to an anchor device (e.g. mechanical anchor, anchor packer, packer, etc). Additional bolts 66 (not shown) extend through the holes 91, 92.

Figure 1F:
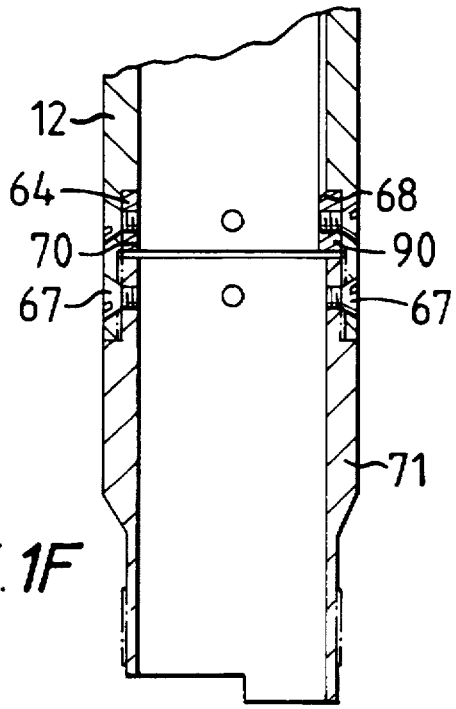
FIG. 1F is a partial view of part of the system as shown in FIG. 1B.

As shown in FIG. 1F, following milling out of the filler 28 and of the plug element 40 a ring 90 remains which has as its lower part at one side a portion of a ramped part 70 of the body 64 and a portion of a ramped part 68 of the body 64. These remaining ramped portions (on the right side of the ring 90 as viewed in FIG. 1F) facilitate the passage of other members, tools, or devices past the ring 90.

The ring 90 as shown in FIG. 1F results when the wellbore in which the system 10 is used is non-vertical so that the whipstock body 12 is tilted to one side within the wellbore. The ring 90 results from milling when the "low side" of the wellbore is the left side of the apparatus as viewed in FIG. 1F. For this reason the portion of the bolts 66 initially projecting into the body 12 and into the adapter 71 are completely milled away since the mill is moving along this side of the apparatus—and it is for this reason that the mill, which must have some clearance to move in the apparatus, does not completely mill off the portion of the bolts projecting into the apparatus from the "high side" (right side) in FIG. 1F. So that such milling does not create a stop member within the apparatus, the remaining part of the ramped portions 68 and 70 are used along which a tool may move more easily as compared to a ring with portions projecting normal to the apparatus side wall. In a vertical or nearly vertical hole, milling produces a resulting ring with a ramped portion around all or around substantially all of the top and bottom of the ring. If desired, a ramp may be used on only one side (top or bottom, e.g. 68 or 70) of the original ring.

When the system 10 is being inserted into a wellbore, fluid in the wellbore is permitted to flow up through the plug element 40 as the valve member 58 opens in response to the fluid. The fluid flows up and out from the whipstock body 12 through the channel 41 of the tube 42, thus buoyancy of the system 10 is not a problem while it enters and passes down through the wellbore.

Preferably parts of the plug element 40 are made of brass, plastic, bronze, epoxy resin, aluminum, composite material, iron, cast iron, relatively soft bearing material, fiberglass, some other readily millable material, or a combination thereof. In certain aspects the locating plate 46, rod 44 and tube 42 are positioned so that the plug element 40 will be on the "high side" when the system 10 is disposed in a non-vertical wellbore (with the rod 44 closer to the "low side" than the tube 42).

The plug element 40 serves to maintain filler 28 in the recess 30 as the filler is initially fed into the recess 30 and prior to setting of the filler. The plug element 40 maintains the filler 28 in the recess 30 when a mill is milling out the filler 28 thus preventing a mass of the filler 28 from exiting the whipstock body 12 and falling down into a wellbore. The plug element 40 also prevents the force of a hydrostatic head of fluid in the wellbore from pushing the filler 28 or part of it upwardly and out from the recess 30. Any known and appropriate valve device or apparatus may be used instead of the valve member 58. To facilitate maintenance of the filler in the recess, interior indentations or threads may be provided on the recess and/or an initial coating of epoxy resin and/or fiberglass fibers is applied to the interior of the recess and allowed to set.

FIG. 2A shows a running tool 100 releasably attached by a shear bolt 115 (shearable, e.g. in response to about 30000 lbs of force) to the top 14 of the whipstock body 12. Fluid (e.g. working fluid, water, mud) pumped from the surface by a surface pumping unit, not shown) flows down a tubular string (not shown) to which the running tool 100 and the system 10 are connected through a channel 108 through a fill-up sub 102, past a valve 120, and through a channel 110 of a body 104. This fluid then flows through holes in a centralizer 131 that centralizes a piston 134 and a rod 132 in a body 106. An end 133 of the rod 132 is held in a recess 138 in the body 106. When the fluid is of sufficient force, shear screws or pins 137 holding a piston 134 to a holding member 135 are severed and the fluid pushes the piston 134 down on the rod 132. Fluid, e.g. oil, in a cavity 136 in the body 106 is thus forced out from the cavity 136, through a port 139, into an hydraulic line 114 (shown partially) which extends down along the system 10 (and/or through the plug element 40) to an hydraulically settable anchor device (not shown) for anchoring the system 10 at a desired location in a wellbore or in a tubular member. To check anchor setting, weight is applied to the system 10 through the running tool 100. The teeth 16 of the whipstock body 12 and corresponding teeth 116 of the running tool 100 transfer the load (e.g. about 80,000 pounds) to the whipstock body and thus to the anchor device. These teeth also isolate the sacrificial element 20 and the shear bolt 115 from the downward load. In certain aspects this facilitates insertion of the system 10 through tight spots in a tubular string and permits a relatively large load to be applied without prematurely shearing the shear bolt 115 and insures that the sacrificial element 20 is not inadvertently damaged or sheared off.

While the running tool is being introduced with the system 10 into a wellbore, fluid in the wellbore flows from outside the running tool through a port 149, through a groove 151 surrounding the interior of the body 104, through a channel 152 in a body 141, up to and out through a port 161, out a channel 163, and up into the channel 108 of the sub 102 up into the working string. Thus buoyancy of the system and of the running tool is reduced or eliminated.

A valve member ball 127 as shown in FIG. 2A is seated against a valve seat surface 169, thereby preventing fluid flow out from the port 149 (e.g. when actuating an anchor device with fluid under pressure through a channel 140). A spring-loaded cylinder 122 is urged down by a spring 124 to hold the ball 127 against the valve seat surface 169. The spring 124 has its top end biased against an inner top surface of a retainer 123 and its lower end biased against a shoulder on the exterior of the cylinder 122. The retainer 123 is secured to a top 126 of the body 141. A spacer 121 holds the body 141 in position.

A rupture disc (or discs) 145 is disposed across a channel 146 and is held in place against a seal 147 in a recess 143. Initially the rupture disc 145 prevents fluid flow through the channel 146. Once the running tool 100 has been separated from the whipstock body 12 by shearing the shear bolt 115 with an upward pulling force following correct positioning of the whipstock body 12 and setting of its anchor (using typical positioning devices, e.g. a gyro) and the running tool 100 is to be raised and removed from the wellbore, the force of fluid pumped from the surface under pressure to the running tool and in the string to which the running tool is attached ruptures the disc 145 and pumped fluid from within the string flows down through the running tool, through the channel 140 and out through the port 146 draining the workstring thereby facilitating removal thereof. Thus the fluid in the string is drained therefrom into the wellbore.

FIG. 3 shows a starting mill 200 useful with the system 10 for forming an initial window, e.g. in casing in which the system 10 is positioned. The starting mill 200 has a body 202 with a fluid flow channel 204 therethrough (shown in dotted lines). Three sets of cutting blades 210, 220, and 230 with, respectively, a plurality of blades 211, 221, and 231 are spaced apart on the body 202. Jet ports 239 are in fluid communication with the channel 204. A nose 240 projects down from the body 202 and has a tapered end 241, a tapered ramped portion 242, a tapered portion 243, and a cylindrical portion 244. In one aspect the nose is made of readily millable material and is releasably secured to the body 202; e.g. so that it can be twisted off by shearing a shearable member that holds the nose to the body. Then the released nose may be milled by the mill. The nose 240 may have a fluid flow channel and valve as shown, e.g., in the system of FIG. 13.

The nose 240 is sized, shaped and configured so that it contacts the sacrificial element 20 as the mill 200 initially moves down in a wellbore to mill and mill through a tubular, e.g. casing or tubing (not shown). The nose 240 contacts and moves down along and adjacent the sacrificial element 20 as the blades first contact and begin milling into the casing to form the initial window at the desired location. The nose 240 and its co-action with the sacrificial element 20 keep the mill 200 from contacting and milling the whipstock body 12. The cylindrical portion 244 of the nose 240 acts like a bearing against the sacrificial element 20. After the mill 200 has milled down the casing, e.g. for several inches, it has milled through the casing. For example, with casing approximately 0.5 inches thick, the mill 200 will have milled through the casing after milling down three to four inches. Then the mill 200 continues to move down and mill more casing to form the initial window.

After the mill 20 has moved downwardly to an extent greater than the length of the nose 240, the blades 231 are in position to mill the sacrificial element 20 in addition to milling the casing opposite the sacrificial element 20. Simultaneously the blades 221 and 211 are milling casing above the sacrificial element 20. At this point the sacrificial element 20 begins to be milled by the blades 231. The sacrificial element 20 as shown is sized and disposed to prevent the blades 231 from milling the whipstock body 12. It is within the scope of this invention for the element 20 to be sized so that some milling of the whipstock body occurs.

In one aspect the mill, the whipstock body, and the sacrificial element are sized, disposed, and configured so that an initial window in the casing of desired length is milled out without the mill contacting the whipstock body or the filler therein. In one aspect such a window is completed with about two inches, one inch, or less of the lower part of the sacrificial element 20 remaining. At this point in the procedure the starting mill 200 is removed from the wellbore. In another aspect the nose 240 is sized, disposed, and configured, e.g. as shown in FIG. 3, so that at the bottom extent of milling there is some minimal clearance between the nose 240 and the interior casing wall so that the nose 240 is not held therebetween and so that damage to the nose 240 is reduced or eliminated.

In one aspect the angle of taper of the tapered portion 243 corresponds substantially to the angle of taper of the face 24 of the sacrificial element 20 so the contact between the two is effected to maximize the ability of the sacrificial element 20 to direct the mill away from the whipstock and against the casing. Also, in this embodiment the taper angle of the tapered portion 243 is such that when milling is finished (see FIG. 6D) the tapered portion 243 is substantially parallel to the interior casing surface adjacent the nose 240 inhibiting wedging contact of the two and reducing friction therebetween.

In one particular embodiment sacrificial element 20 is about 30 inches long (excluding the extending top part with teeth) and the blade sets of the mill 200 are spaced apart about two feet and the nose 240 is about 18 inches from its lower end to the first set of blades 231. With such a mill a completed initial window is about 60 inches long. It is within the scope of certain preferred embodiments of this invention for the initial window through the casing to be two, three, four, five, six, seven or more feet long.

Figure 4:
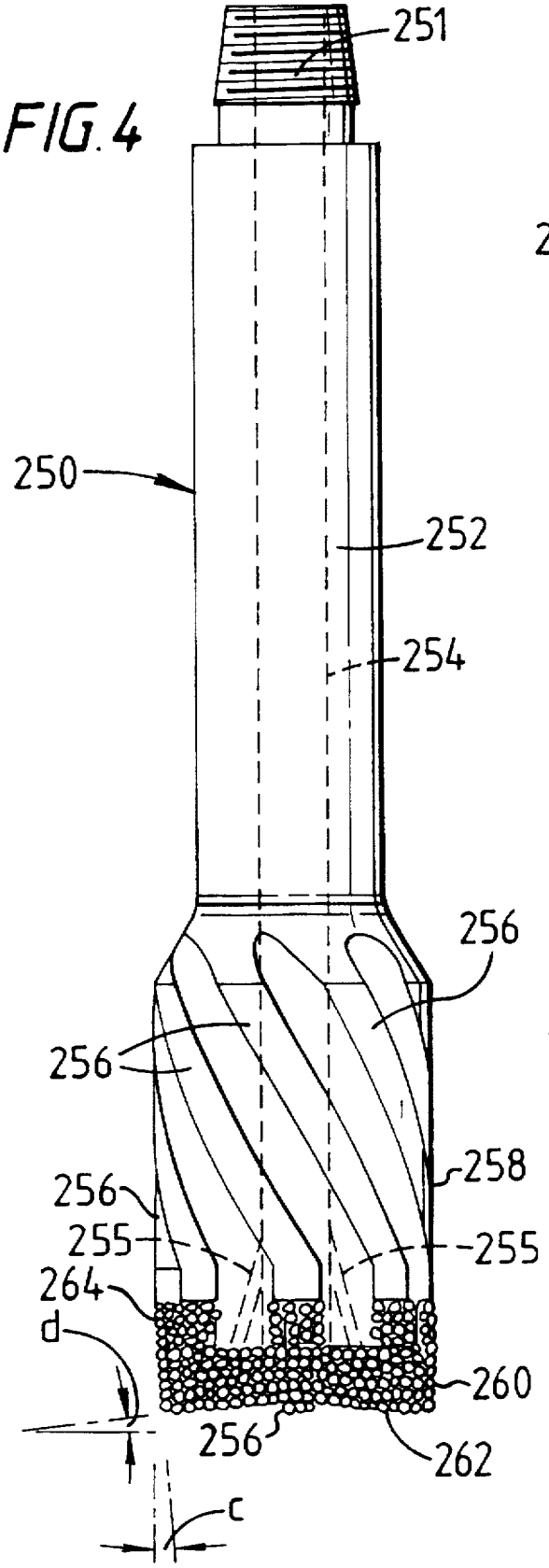
FIG. 4 is a side view of a mill according to the present invention.

FIG. 4 shows a window mill 250 for use to enlarge the window made by a mill, including but not limited to the mill 200. The window mill 250 has a body 252 with a fluid flow channel 254 from top to bottom and jet ports 255 to assist in the removal of cuttings and debris. A plurality of blades 256 present a smooth finished surface 258 which moves along what is left of the sacrificial element 20 (e.g. one, two, three up to about twelve to fourteen inches) and then on the filler 28 and the edges of whipstock body 12 that define the recess 30 with little or no milling of the filler 28 and of the edges of the whipstock body 12 which define the recess 30. Lower ends of the blades 256 and a lower portion of the body 252 are dressed with milling material 260 (e.g. but not limited to known milling matrix material and/or known milling/cutting inserts applied in any known way, in any known combination, and in any known pattern or array).

In one aspect the lower end of the body 252 tapers inwardly an angle C to inhibit or prevent the window mill lower end from contacting and milling the filler 28 and whipstock body 12 (i.e. the angle C is preferably greater than the angle a in FIG. 1A).

In one aspect the surface 258 is about fourteen inches long and, when used with the mill 200 having blades about two feet apart as described above, an opening of about five feet in length is formed in the casing when the sacrificial element 20 has been completely milled down. In this embodiment the window mill 250 is then used to mill down another ten to fifteen feet so that a completed opening of fifteen to twenty feet is formed, which includes a window in the casing of about eleven to fifteen feet and a milled bore into formation adjacent the casing of about five to nine feet.

In one embodiment the lower ends of the blades of the window mill body 252 taper upwardly from the outer surface toward the body center an angle d (FIG. 4). This taper part tends to pull the body 252 outwardly in a direction away from the filler 28, and away from the whipstock body 12 into the formation adjacent the casing, acting like a mill-directing wedge ring. Also this presents a ramp to the casing which is so inclined that mill end tends to move down and radially outward (to the right in FIG. 7E) rather than toward the whipstock.

In one method according to the present invention a mill (such as the window mill 250) mills down the whipstock, milling a window. Following completion of the desired window in the casing and removal of the window mill, a variety of sidetracking operations may be conducted through the resulting window (and, in some aspects, in and through the partial lateral wellbore milled out by the mill as it progressed out from the casing). In such a method the remaining portion of the whipstock is left in place and may, if desired be milled out so that the main original wellbore is again opened. In one aspect the filler 28 and plug element 40 are milled out to provide an open passage through the whipstock.

Figure 5A:
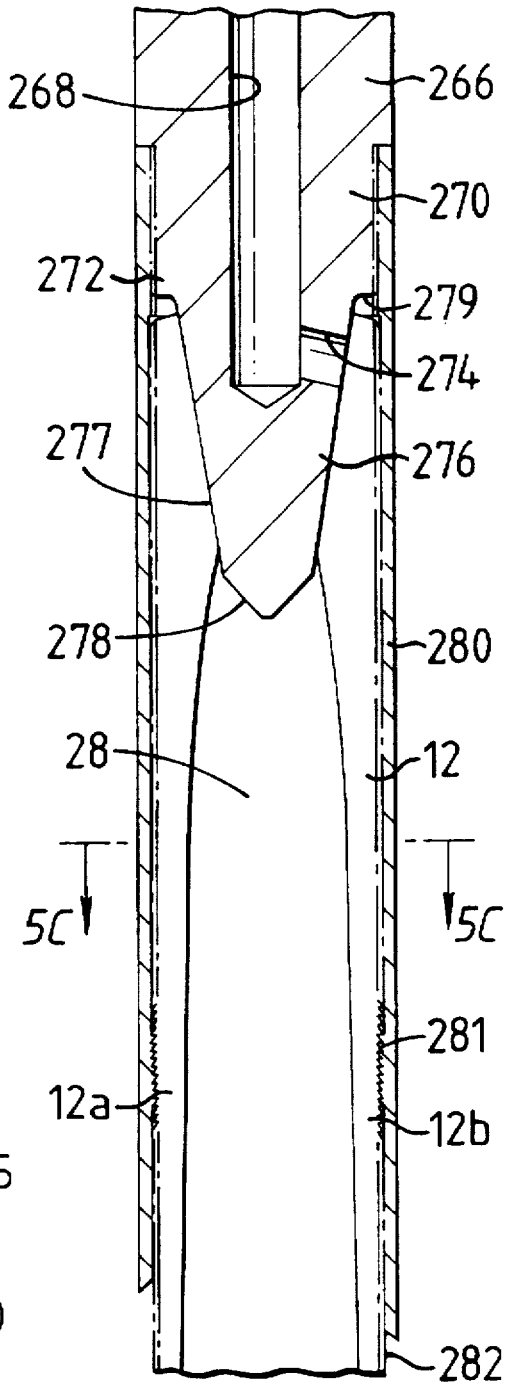
FIG. 5A is a side view in cross-section of a retrieving tool according to the present invention.
Figure 5B:
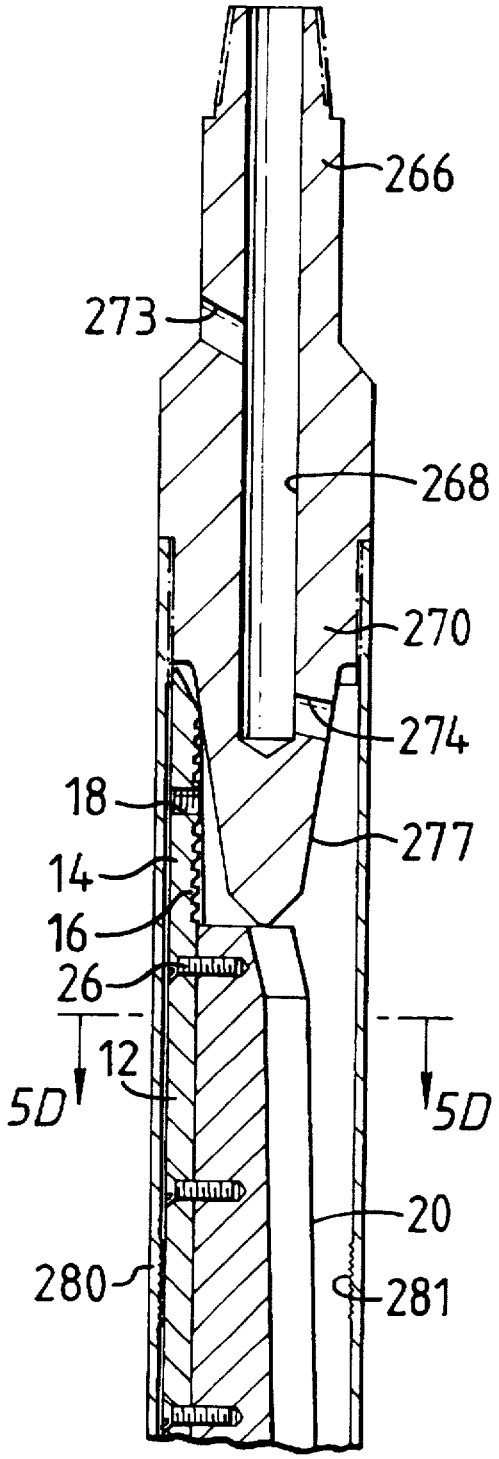
FIG. 5B is a side view in cross-section showing the tool of FIG. 5A engaging a whipstock.
Figure 5C:
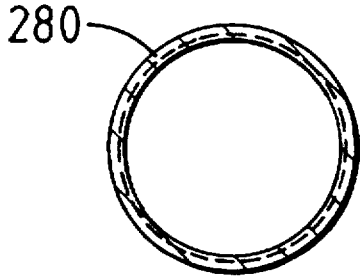
FIG. 5C is a cross-section view along line 5C—5C of FIG. 5A (with the whipstock omitted).
Figure 5D:
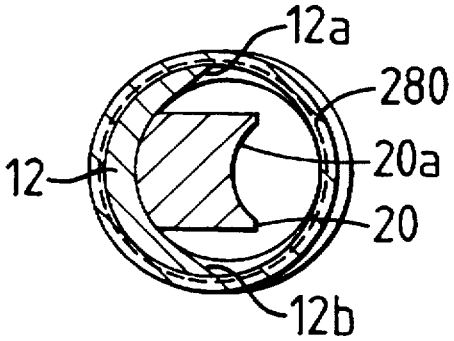
FIG. 5D is a cross-section view along line 5D—5D of FIG. 5B.

In another aspect, in the event there is a problem in the milling operation prior to completion of the window, the whipstock is removed. As shown in FIGS. 5A and 5B, a retrieving tool 270 with a body 272 has a barrel 280 threadedly connected to the body 272. A fluid flow channel 268 extends down into the body 272 from a top end thereof and is in fluid communication with a top channel 273 and a side channel 274 so that fluid may be pumped through or flow through the retrieving tool 270. As shown in FIG. 5A, the tool 270 has been inserted into the wellbore and has contacted the whipstock body 12. Preferably the threads 281 are positioned on the barrel 280 interior so that corresponding threads on the whipstock body are not engaged until the barrel has moved down over a significant portion of the whipstock body so that threaded engagement does not occur at a relatively thin portion of the top of the whipstock. Interior threads 281 of the barrel 280 have threadedly mated with exterior threads 282 of the whipstock body 12. A nose 278 of the body 272 has entered a space between the casing and the top of the whipstock body 12. The body 272 may be connected to a string of hollow tubular members, e.g. but not limited to a drill string or workstring.

FIG. 5B illustrates the tool 270 as it first contacts the whipstock top 14 before any milling has been done. To retrieve a whipstock from the position shown in FIG. 5B, the tool 270 (e.g. on a drill string) after engaging the whipstock is pulled upwardly (e.g. with 30,000 to 80,000 or more pounds of force). A tapered surface 277 of the nose 278 contacts the top 14 and (when the system 10 is in a non-vertical hole with the whipstock on the "low" side of the hole) pushes down on it thereby leveraging and lifting the whipstock body 12 away from the "low" side of the casing facilitating the engagement of the threads 281 with the threads 282. Upon correct engagement of the whipstock by the tool 270, the whipstock is removed from the wellbore by removing the drill string from the wellbore (e.g. by pulling with about 100,000 lbs force which, in certain aspects releases the whipstock from the anchor e.g. by shearing a shearable whipstock stinger from an anchor device). The sacrificial element, although present, is not shown in FIG. 5A. The tool 270 may also be used following milling.

Filler 28 may be cermet, cement, brass, fiberglass, bronze, wood, bearing material, cast iron, polymer, epoxy resin mixed with fiberglass fibers, resin, plastic, or some combination thereof.

Figure 6A:
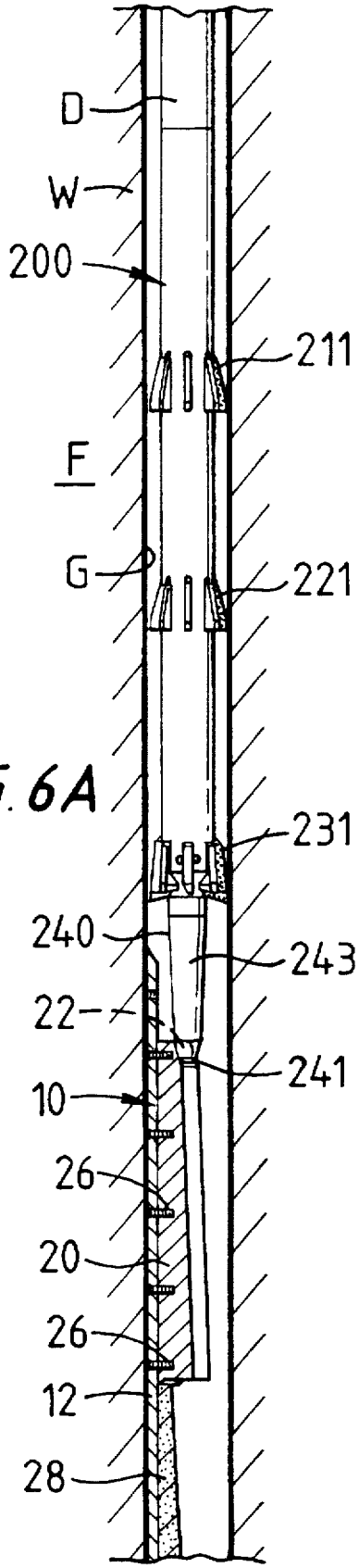
FIGS. 6A–6D show an operation of the system of FIGS. 1A and 3.

FIGS. 6A–6D illustrate steps in a method using the systems 10 and mill 200. The mill 200 is connected to a working string D that extends to the surface. As shown in FIG. 6A, the system 10 has been located, positioned, and anchored in a tubular string of casing G that extends down from the earth's surface (not shown) in a wellbore W through an earth formation F. The tapered end 241 of the nose 240 of the mill 200 has contacted the first face 22 of the sacrificial element 20. Preferably the blades 211, 221, 231, do not touch the casing on the whipstock side (left side, FIG. 6A) and are held against the casing on the opposite side (right side, FIG. 6A) both by the co-action of the tapered end 241 with the first face 22 and by a stabilizer S (any known stabilizer or smooth faced or smooth bladed mill, e.g. a starting mill with smooth outer surfaces). At this point milling is started by rotating the mill 200 (e.g. by rotating with the surface rotary the string D to which the mill 200 is attached that extends to the surface; or by using a downhole motor positioned in the string above the mill.

Figure 6B:
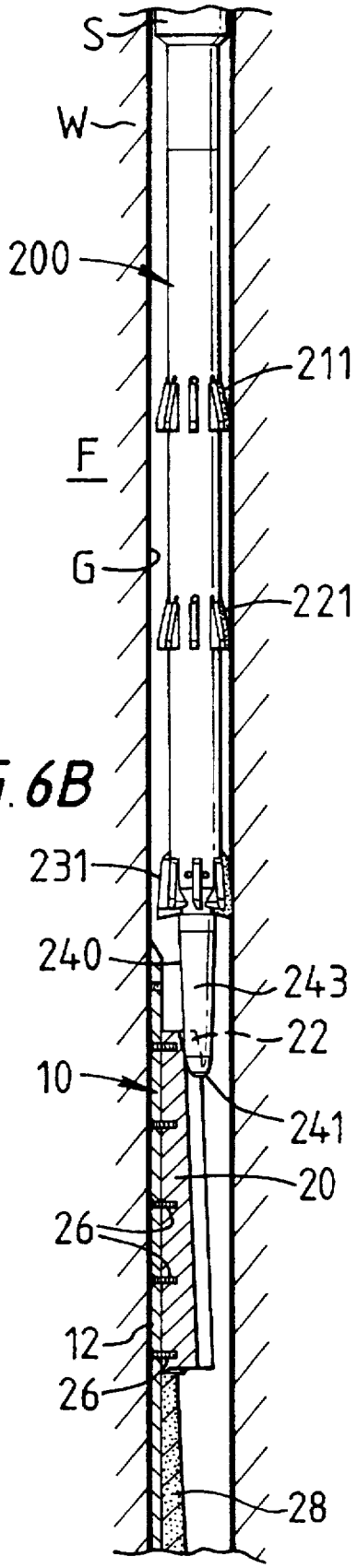

As shown in FIG. 6B the three sets of blades of the mill 200 have begun to mill into the casing G; the tapered portion 243 of the nose 240 has moved down to contact the sacrificial element 20; and the blades are held away from the whipstock side (left side, FIG. 6B) of the casing G.

Figure 6C:
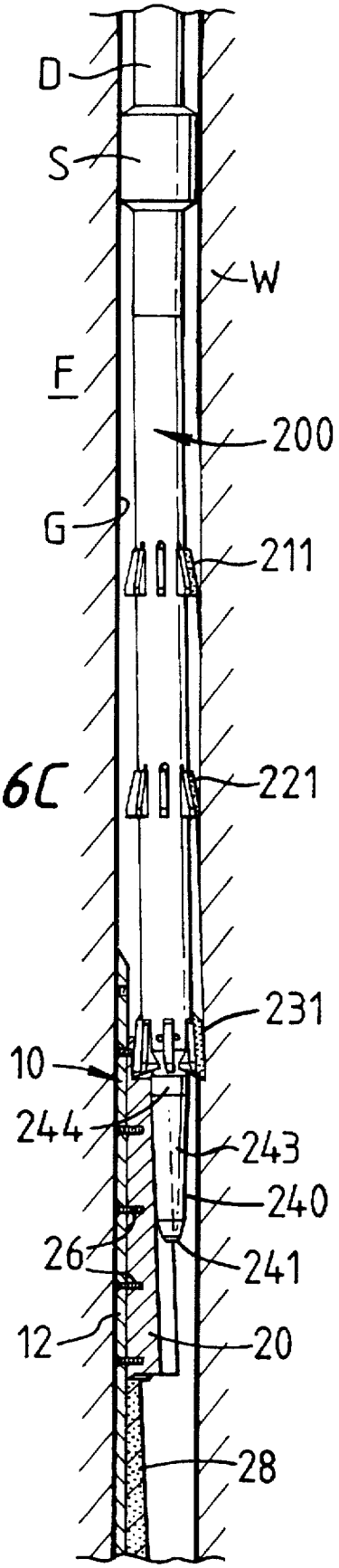

As shown in FIG. 6C, the tapered portion 243 of the nose 240 has continued to move down and co-act with the second face 24 of the sacrificial element 20; the blades 231 have milled through the casing G; the blades 231 have milled away part of the sacrificial element 20; the three sets of blades have been directed away from the whipstock side of the casing G; the blades 221 have milled through the casing G; the blades 211 have milled and are about to mill through the casing G; the nose 240 is not caught or wedged in between the sacrificial element 20 and the inner wall of the casing G; part of the top bolt 26 has been milled away; and the whipstock body 12 and filler 28 are not milled by the mill 200.

Figure 6D:
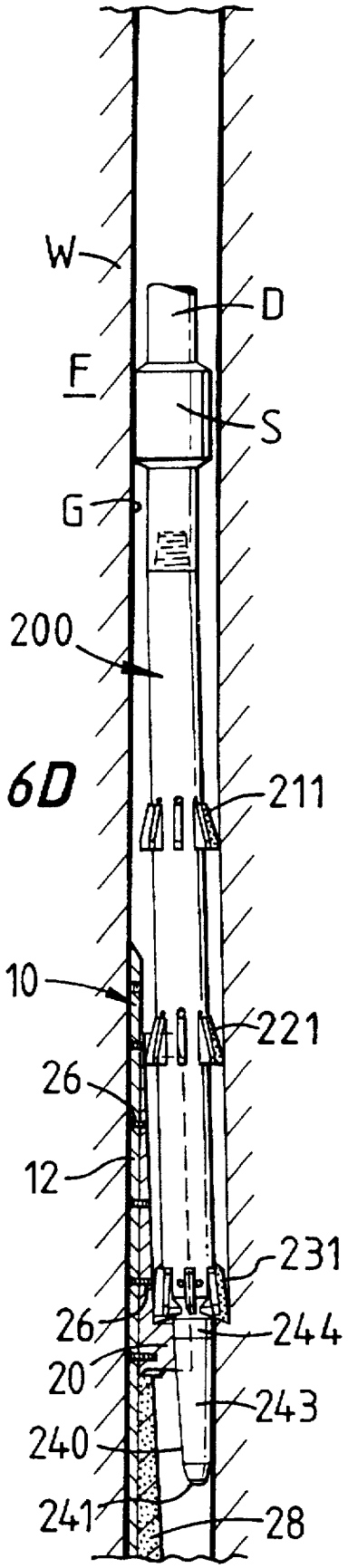

As shown in FIG. 6D an initial casing window I has been completed; the surface 244 acts as a bearing surface against the second face 24; portions of bolts 26 have been milled away; parts of the formation F has been milled away; the majority of the sacrificial element 20 has been milled away and a portion of the sacrificial element 20 remains; the whipstock body 12 and filler 28 have not been milled (or in other aspects only a minor portion of the top of the whipstock body 12 has been milled); the nose 240 has moved freely or with minimal contact of the casing G to the position shown; the cylindrical portion 244 is wedged between the element 20 and the casing G indicating at the surface that there is no more progression of the mill; and the mill 200 is ready to be removed from the wellbore so that further milling with additional mill(s) can be done to complete the desired window. Preferably the nose 240 (other than portion 244) is not touching the casing G or only has incidental contact therewith.

Figure 7A:
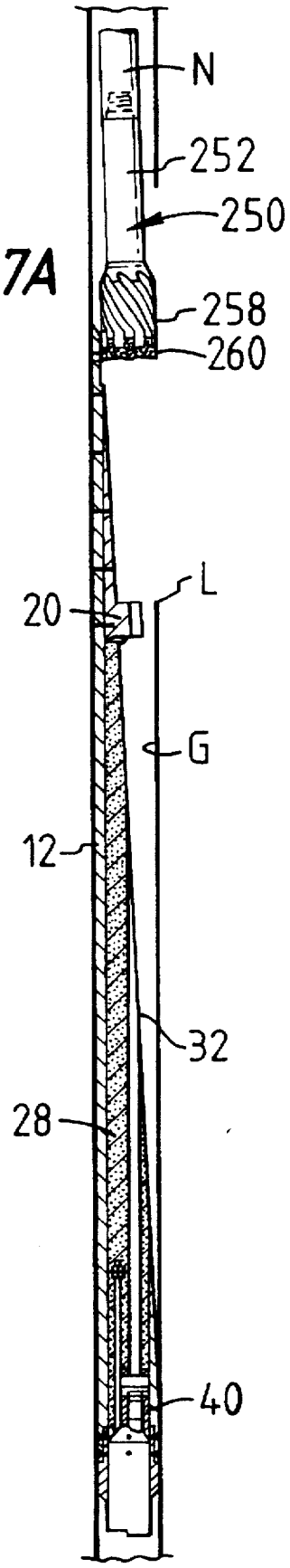
FIGS. 7A–7E show operation of the system of FIGS. 1A and 4.

If the initial window as shown in FIG. 6D is suitable, no other milling is done. If the window in FIG. 6D is to be enlarged and/or lengthened, another mill or series of mills is introduced into the wellbore. As shown in FIG. 7A, the mill 250 (FIG. 4A) has been run into the wellbore (e.g. on a tubular string N of, e.g. a drill string of drill pipe to be rotated from above or to be rotated with a downhole motor as described above). The inwardly tapered portion 260 of the body 252 of the mill 250 preferably does not mill the top of the whipstock body 12 or mills it minimally.

Figure 7B:
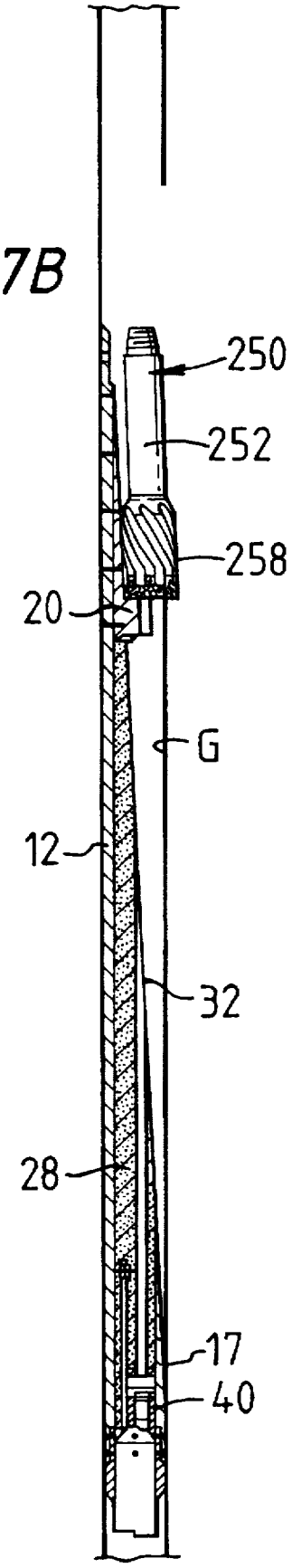

As shown in FIG. 7B the mill 250 proceeds down along the remainder of the sacrificial element 20 with the mill surface 258 holding the milling end away from the sacrificial element and directing the mill 250 away from the body 12 toward the casing G. The inwardly tapered portion of the mill 250 (tapered at angle d, FIG. 4) encounters a ledge L created by the mill 200, and due to the inwardly tapered portion, the mill moves outwardly with respect to the ledge L, begins to mill the casing G, and also begins to mill the remainder of the sacrificial element 20. The surface 258 will continue to co-act with the resulting milled surface on the sacrificial element 20 until the surface 258 is no longer in contact with the sacrificial element 258 as the mill 250 mills down the casing G. Thus the window, (at the point at which the mill 250 ceases contact with the sacrificial element 20) that includes the initial window formed by the mill 200 and the additional portion milled by the mill 250 is created without the mills contacting the whipstock body 12 or the filler 28. The tubular string N is present, but not shown, in FIGS. 7B–7F.

Figure 7C:
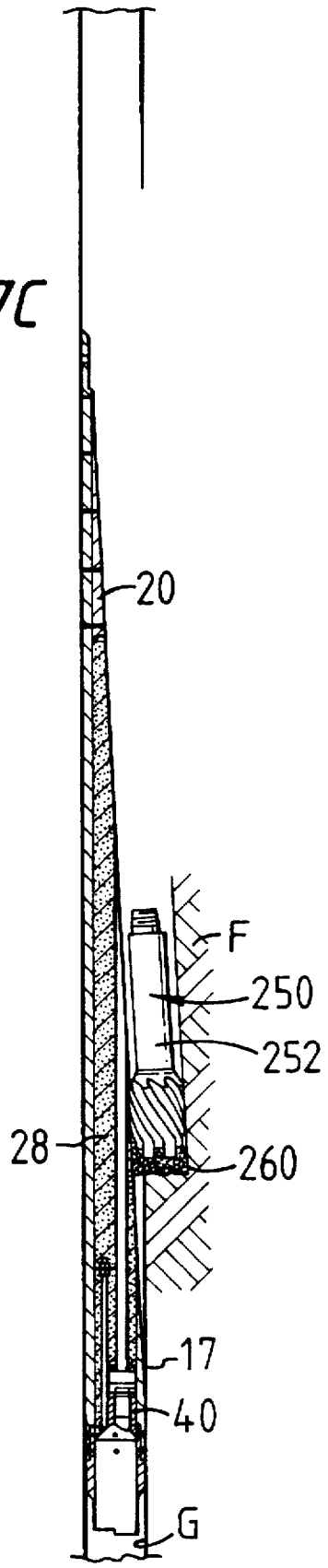

As shown in FIG. 7C, the mill 250 has continued to mill out the window in the casing G and has both contacted the whipstock body 12 and begun to mill a bore B into the formation F (e.g. a bore suitable for sidetracking operations). Preferably the surface 258 of the mill 250 is contoured, configured and shaped to correspond to the curved shape presented by the rails 12*a* and 12*b* (see FIG. 1C) so that these parts of the body 12 have more than point contact and effectively direct the mill 250 away from the whipstock. The radiused face 32 of the whipstock body 12 and filler 28 also assists in directing the mill 250 at a desired angle away from the whipstock. Eventually the mill 250 contacts a straight (non-radiused) face 17 of the whipstock body and filler material 28.

Figure 7D:
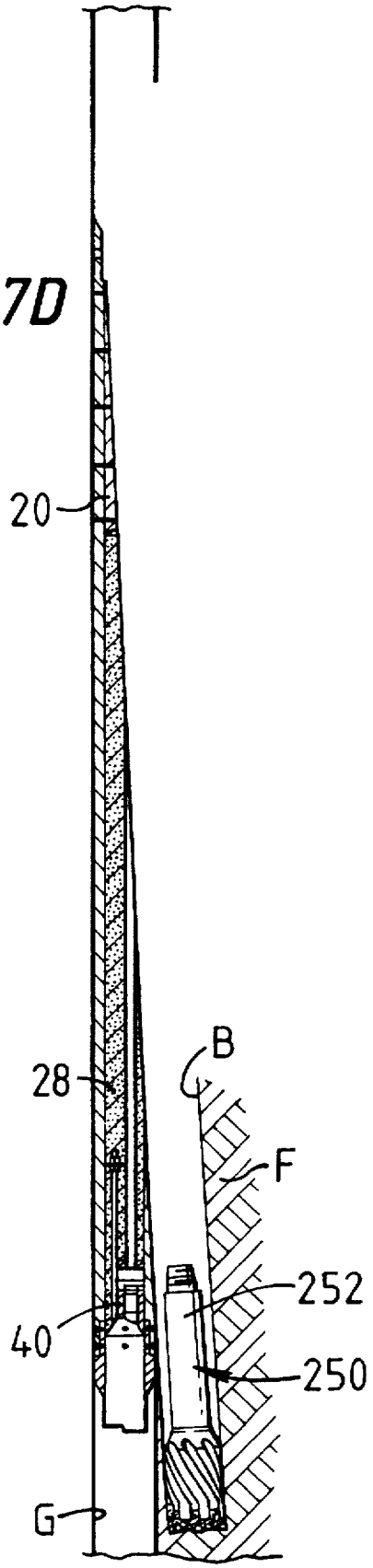
Figure 7E:
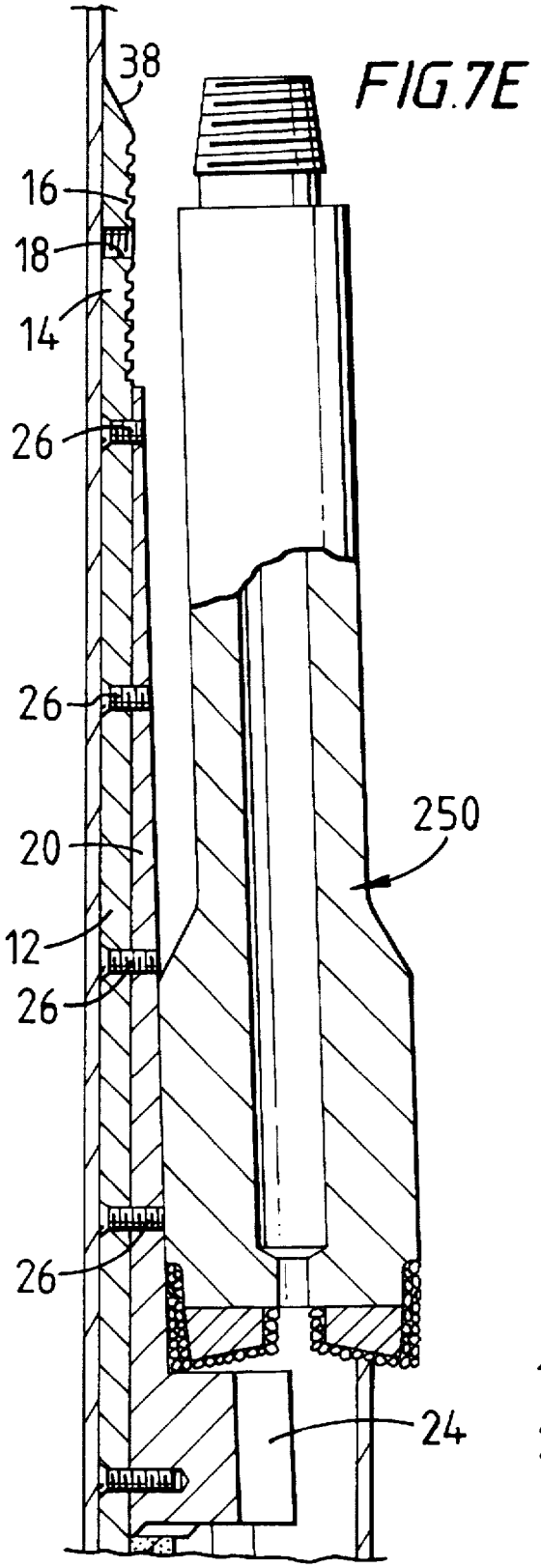

As shown in FIG. 7D the mill 250 has milled completely through the casing G and has extended the bore B down beyond the plug element 40 and the sub 71. Further milling may be conducted with the mill 250 or other mills, or the mill 250 may be withdrawn from the wellbore.

Figure 7F:
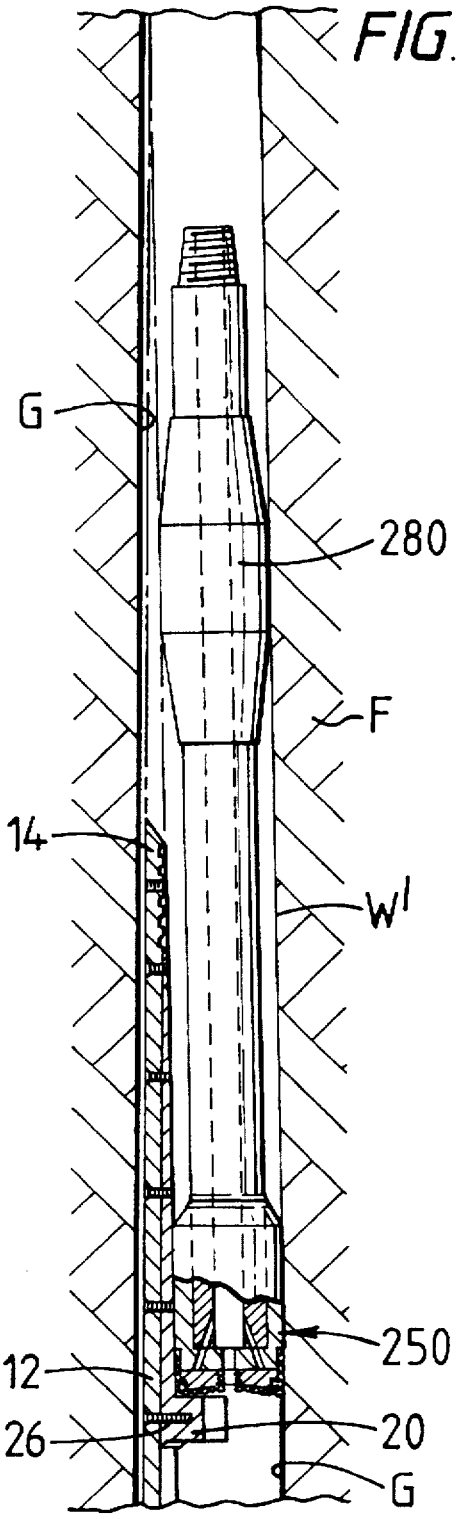
FIG. 7F shows a mill as in FIG. 7E with a watermelon mill.

An additional mill or mills as desired may be used above the mill 250. As shown in FIG. 7F a watermelon mill 280 is used above the mill 250 to facilitate milling, window formation, and smoothing of milled surfaces.

The filler 28 may have a metal sheath or shield covering exposed portions thereof. The filler 28 may be one or more containers of filler material positioned in the originally hollow portion of the whipstock. These containers may be relatively rigid, e.g. steel plate, or relatively flexible, e.g. metal foil or plastic of sufficient thickness, yet puncturable, ruptureable by pressure and/or chemicals, or tearable so that at a desired time their contents (e.g. sand, rocks, liquid, balls of material, granular material, or a mixture thereof) flows out and down away from the whipstock. In one aspect spacers (solid, containers, spoked wheels, etc) are used so that there is a series of filler masses or filler containers and spacers in the hollow portion of the whipstock. In another aspect the spacers are hollow and empty or hollow with liquid or granular material there which easily flows out and down through the tool upon breaking or rupture of the spacer body or wall. In one aspect the sheath, shield, and/or spacers are made of bearing material for contact by a mill or mills.

Figure 11:
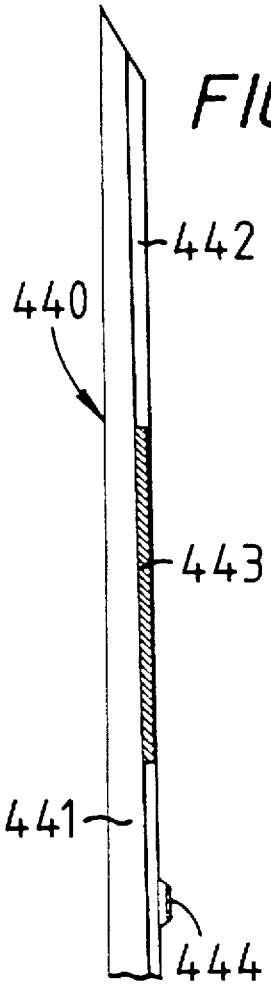
FIG. 11 is a side view of a whipstock according to the present invention.
Figure 12:
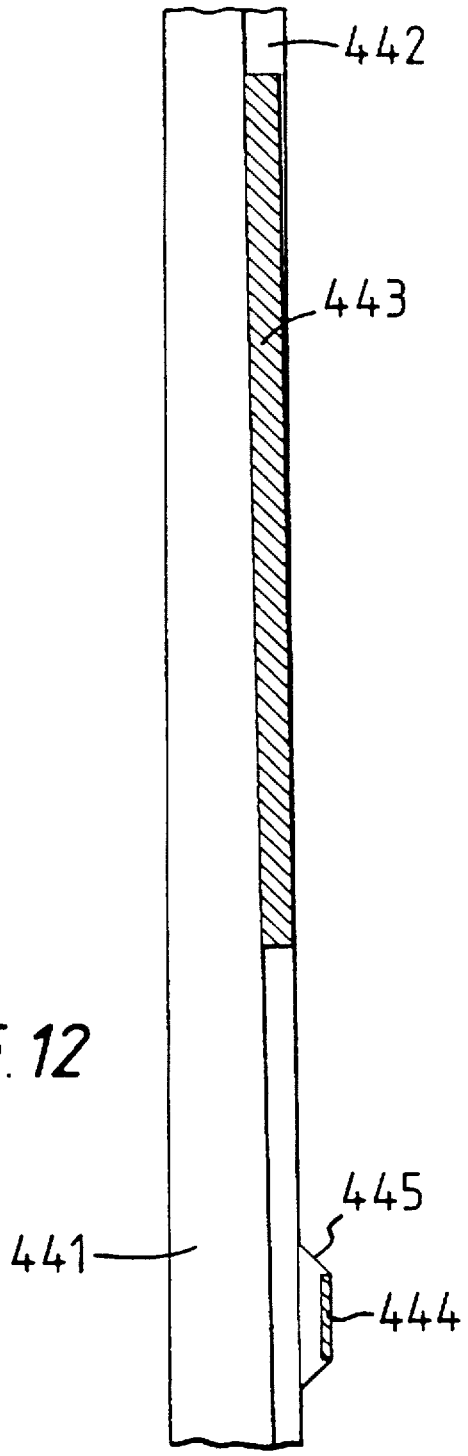
FIG. 12 is an enlarged view of part of the whipstock of FIG. 11.

FIGS. 11 and 12 show a whipstock 440 according to the present invention with a main body 441, a concave portion 442, a lug member 443, and a contact member 444. In one preferred embodiment the lug member 443 is made of a suitable bearing material such as brass.

Figure 13:
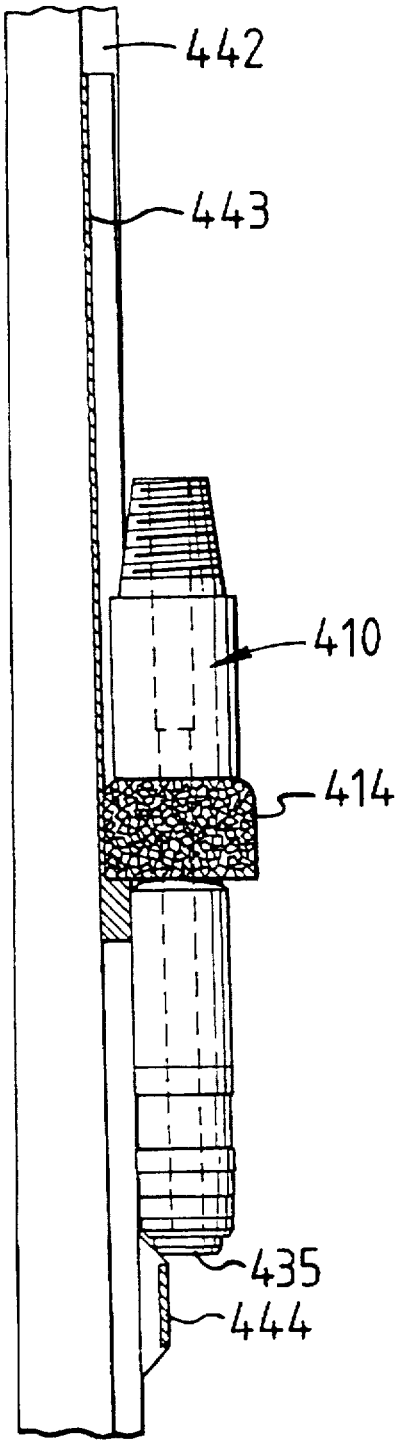
FIG. 13 is a side view showing a mill used with the whipstock of FIG. 11.
Figure 14:
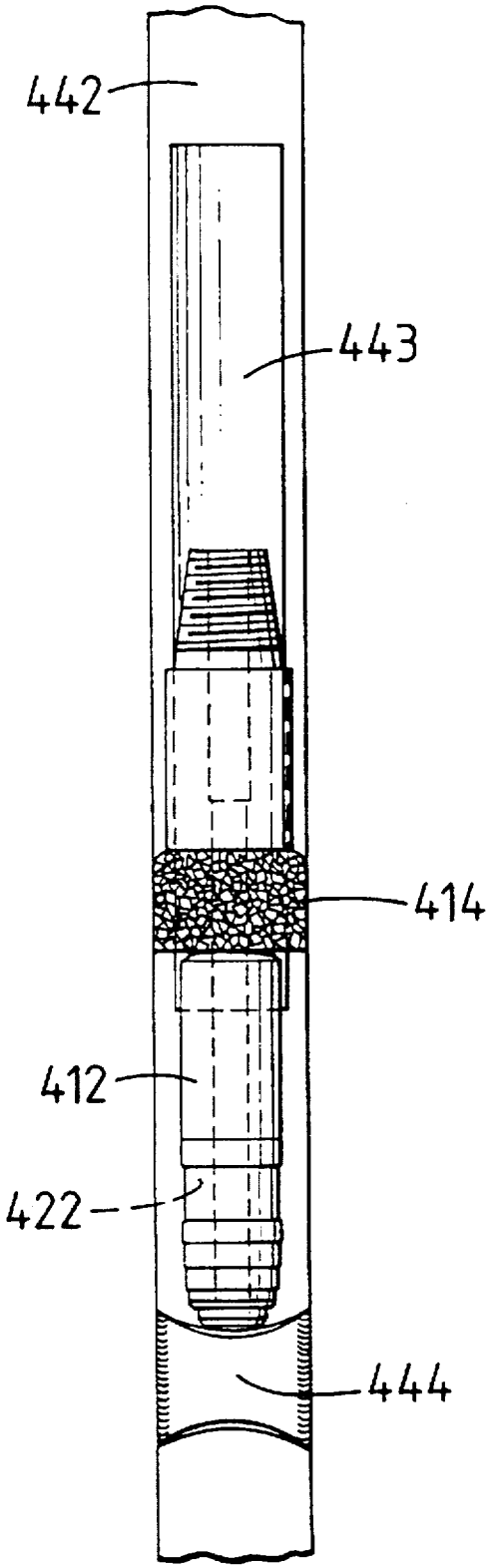
FIG. 14 is a front view of the apparatus shown in FIG. 13.

As shown in FIGS. 13 and 14, an apparatus 410 has moved down the whipstock 440 cutting a window in an adjacent tubular, e.g. a casing (not shown). The majority of the lug member 443 has also been milled away, but preferably the contact member is located and the lug member extends sufficiently so that the mill 414 does not mill into the concave portion 442 and does not mill down past the lug member 443. The surface 435 of the valving member 422 has contacted an inclined surface 445 of the contact member 444 and the valving member 422 has moved so that it has closed off fluid flow through the apparatus 410.

Figure 15:
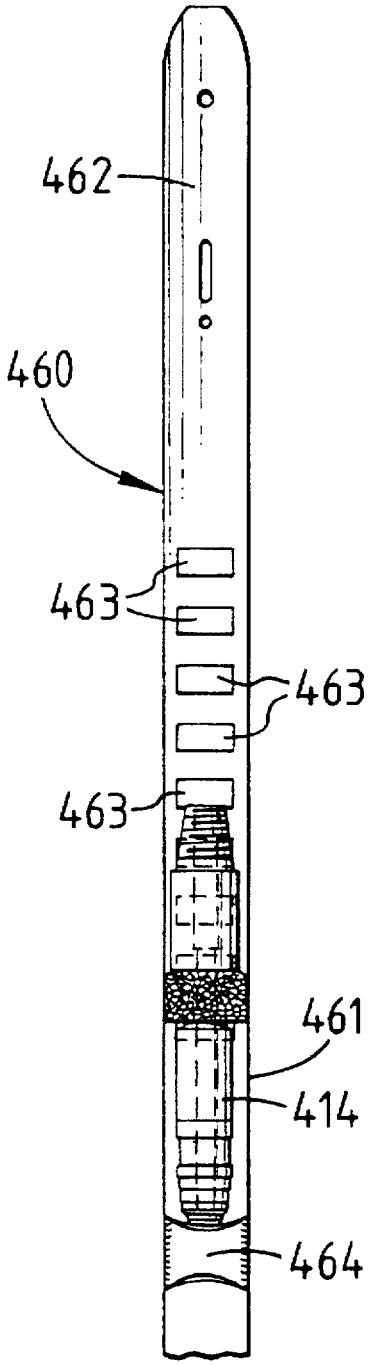
FIG. 15 is a front view of a mill and whipstock according to the present invention.

FIG. 15 illustrates another whipstock 460 according to the present invention with a main body 461, a concave portion 462, a plurality of spaced apart lug members 463 and a contact member 464. Preferably the lug members 463 are sized and positioned so that the mill 414 of the apparatus 410 is always abutting part of one of the lug members 463 so that it is held away from the concave 462 and so that the tubular body below the mill is held off of the concave.

Figure 16A:
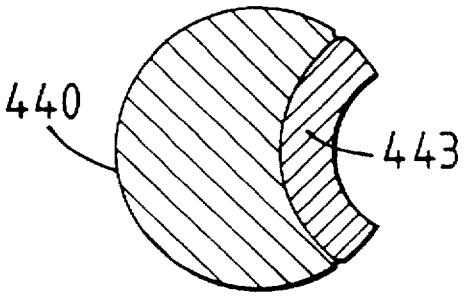
FIG. 16A is a cross-section view along line 16A—16A of FIG. 5.
Figure 16B:
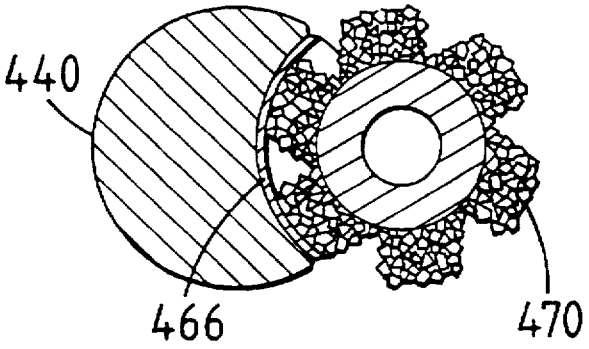
FIG. 16B shows a mill (in cross-section) moving down the whipstock of FIG. 16A.
Figure 16C:
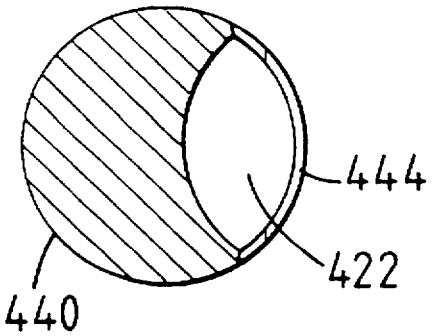
FIG. 16C is a cross-sectional view along line 16C—16C of FIG. 16A.

FIGS. 16A–16C show a variety of crosssectional views through a whipstock such as the whipstock 440. FIG. 16A is a view through such a whipstock 440 and its lug member 443 prior to any milling of the lug member. FIG. 16B shows a ribbed mill 470 which has milled a portion of the lug member 443 leaving a relatively thin part 466 remaining along the concave member 442. FIG. 16C shows the contact member 444 on the whipstock 440 and illustrates a space 422 between the contact member 444 and the whipstock 440 through which fluid is pumpable. This prevents the contact member 444 from providing a large surface against which fluid might be pumped creating a false pressure increase indication at the surface. Also, in this preferred embodiment, use of a curved contact member 444 whose arc completes a full circle with the whipstock 440 as shown in FIG. 16C makes it possible to easily roll the whipstock 440. Also, the contact member 444 spaces the concave member and its lug away from the ground, particularly during rolling of the apparatus. However it is within the scope of this invention to provide a solid contact member or stop with no space between it and the concave of a whipstock or other device with which the valve and/or valve and mill are used.

Figure 8A:
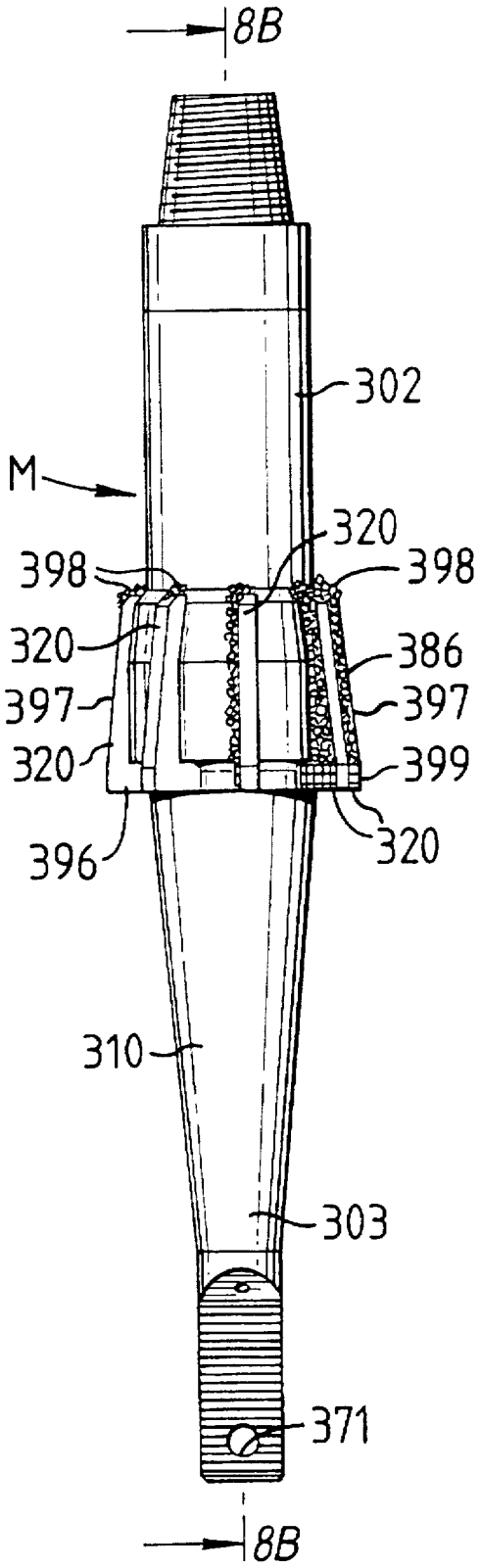
FIG. 8A is a side view of a starting mill according to the present invention.
Figure 8B:
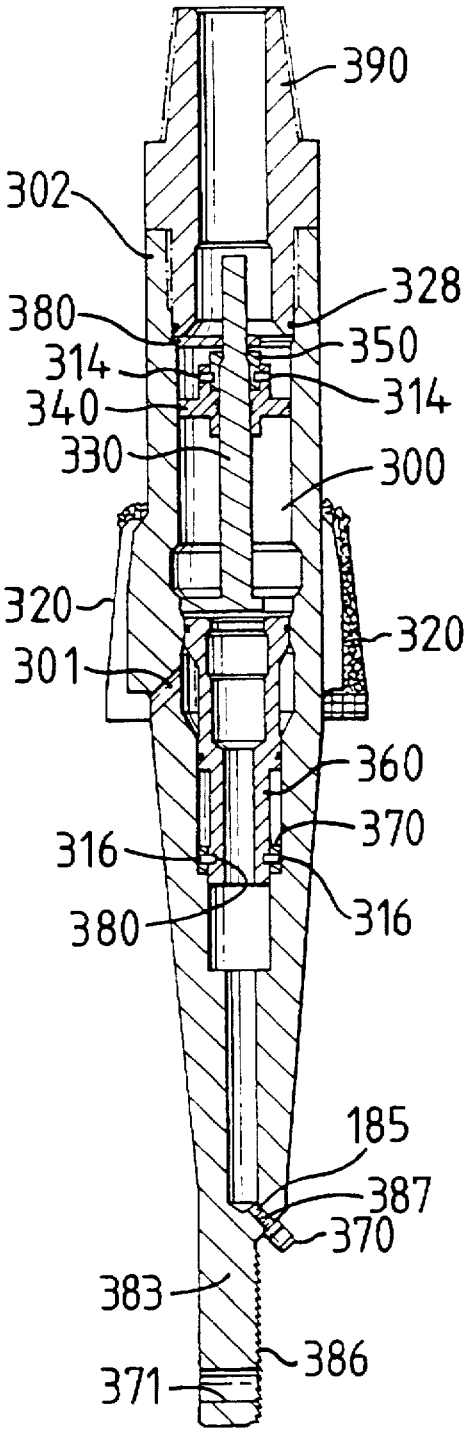
FIG. 8B is across-sectional view of the mill of FIG. 8A.

Referring now to FIGS. 8A and 8B, a starting mill M according to the present invention has a body 310 with a central longitudinal (top-to-bottom) fluid flow bore 300 extending therethrough. Typically the mill M is releasably secured to a concave of a whipstock. A plurality of milling blades 320 are secured (e.g. by welding) to the exterior of the body 310. Such a mill is useful for milling a hole in casing in a wellbore.

Fluid flowing through the body 310 is selectively controlled by flow control apparatus in the body 310 that includes a lower piston 360 releasably secured in a lower part of the bore 300 and movable therein after release; and a labyrinth piston 340 (and associated apparatus) releasably secured in an upper portion of the bore 300 and movable about a top piston rod 330 upon release. A retaining plate 380 stabilizes a top end of the top piston rod 330. A top sub 390 is releasably secured to a top end 302 of the body 310.

The labyrinth piston 340 is initially secured in place by shear pins 314 that extend through holes in the labyrinth piston into recesses in a shear sub 350 which is affixed about the top piston rod 330. Shearing of the pins in response to fluid pumped into the wellbore at a first fluid pressure releases the labyrinth piston 340 for movement in the bore 300 and effects breaking of a plug 387 in a lower male connector 370 so that fluid flows through an hydraulic line to set an anchor (not shown) below the whipstock.

The lower piston 360 is initially secured in place by shear pins 316 extending from holes in a shear ring 370 in the bore 300 into recesses 380 in a bottom end of the lower piston 360. Shearing of the pins 316 in response to fluid at a second fluid pressure (greater than the first fluid pressure) releases the lower piston 360 for movement in the bore 300 so that fluid flow ports 301 adjacent the blades 320 are exposed to fluid flow.

A cavity extending from a lower exit port 385 to the labyrinth piston 340 is initially filled with a clean fluid (e.g., but not limited to, water, drilling fluid, ethylene glycol solution, or a combination thereof) which is held in place by the labyrinth piston 340 at the top and, during shipment, by the plug 387 removably positioned in the male connector 370 provided at the exterior of a lower exit port 385 to which an hydraulic line or other item may be connected. Below the cavity the hydraulic line and packer or other anchor are filled with fluid so fluid is maintained in the cavity.

Eight blades 320 are shown, but any desired number (one, two, three, four, etc.) may be used. Each blade 320 has three primary milling surfaces: a lower part 396; a mid-portion 397; and a top part 398. It is within the scope of this invention for any or all of these parts to be dressed with any known milling inserts, matrix material, or combination thereof in any known disposition, configuration, array, or pattern. Fluid under pressure to facilitate evacuation of debris and cuttings away from the blades 320 flows out from the bore 300 through fluid flow ports 301 which, preferably, exit the body near the lower parts 396 of the blades 320.

Figure 9A:
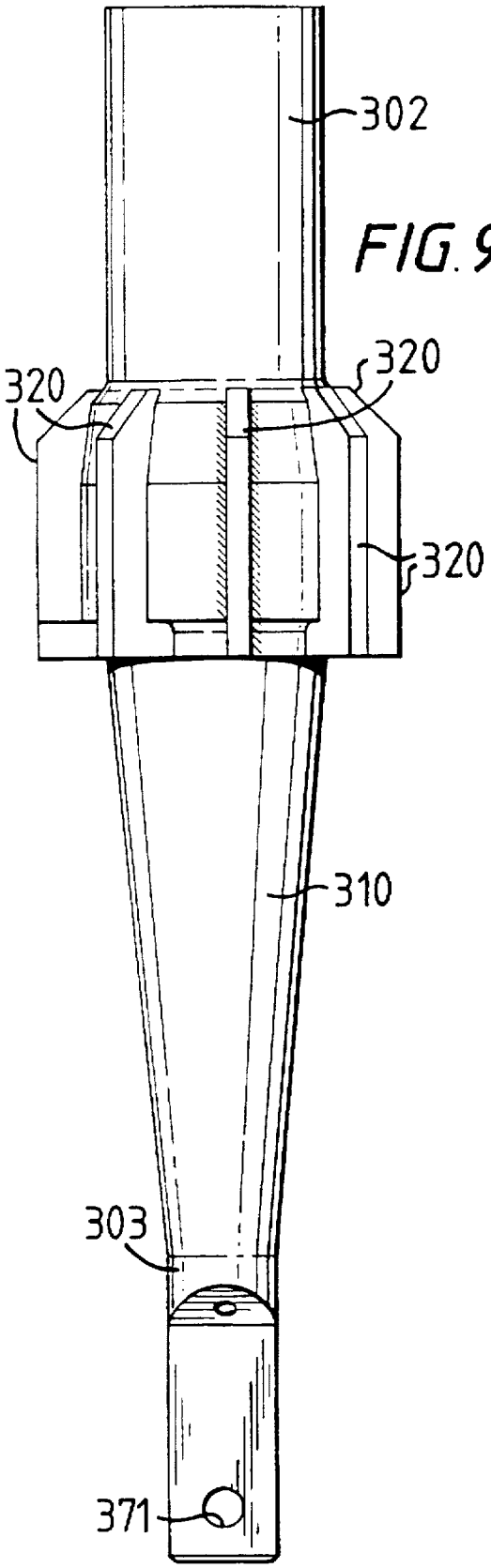
FIGS. 9A is a side view of the main body of the starting mill of FIG. 9A.
Figure 9B:
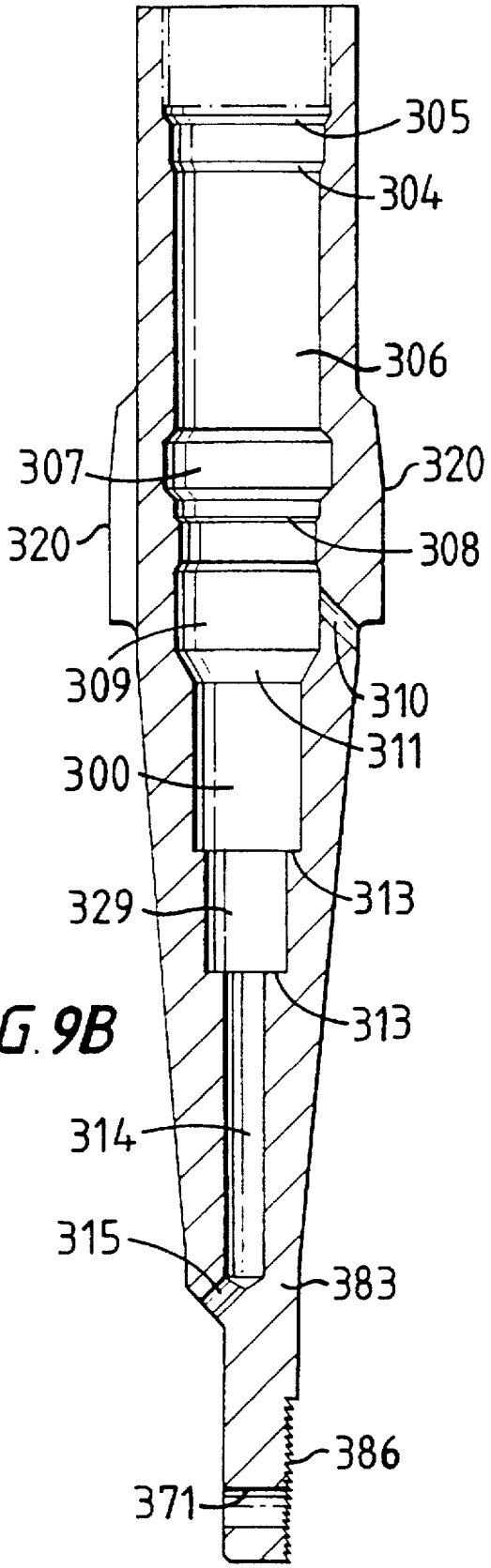
FIG. 9B is a cross-sectional view of the body of FIG. 8A.

FIGS. 9A–9B illustrate the body 310 and its bore 300. The body 310 has a top shoulder 305; an upper shoulder 304; a top cavity 306; an enlarged cavity 307; a plate shoulder 308; a mid-cavity 309; fluid flow ports 310; a lower piston shoulder 311; a lower shoulder 312; and a bottom shoulder 313.

Ratchet (or "wicker") teeth 386 are provided on a side of the lower end 383 of the body 310. The teeth 386 are profiled so that upon pushing down on the body 310 the teeth contact and engage teeth on a whipstock and downward force is transmitted to the whipstock while the downward force is isolated from a shear stud (not shown) extending through a hole 371 in the body 310 into a pilot lug of the whipstock (not shown). The teeth 386 are also profiled so that in response to an upward pull on the body 310 there is no engagement with the corresponding teeth on the pilot lug (i.e., the teeth slide away with respect to each other), the shear stud is not isolated from the force of such upward pulling, and the shear stud is shearable when enough upward force is applied, e.g. twenty thousand to thirty thousand pounds.

Figure 10A:
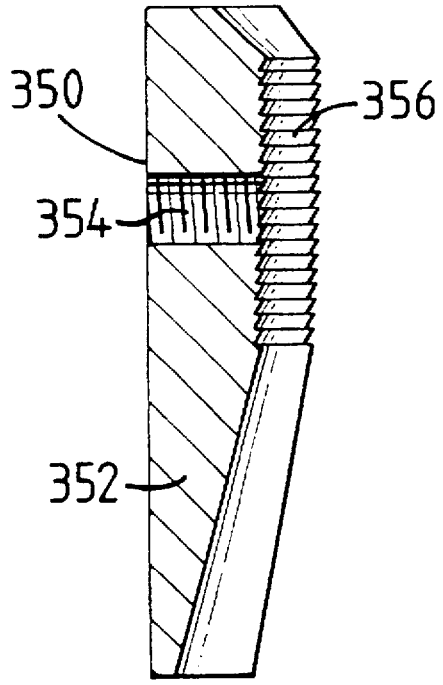
FIG. 10A is a perspective view of a pilot lug of a whipstock according to the present invention.
Figure 10B:
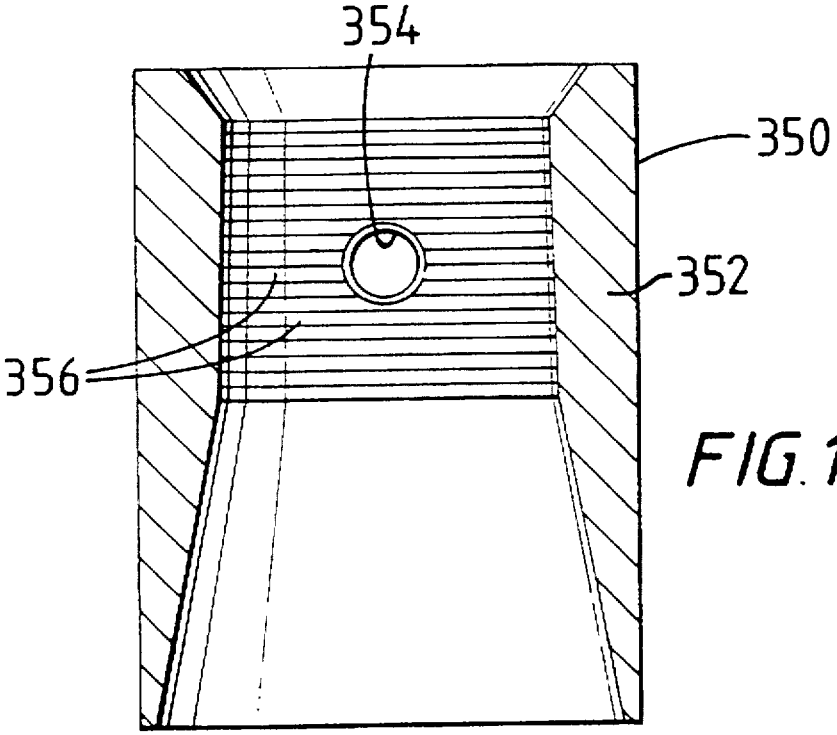
FIG. 10B is a front view of the pilot lug of FIG. 10A.

FIGS. 10A and 10B show a pilot lug 350 according to the present invention with a body 352 having a hole 354 therethrough through which a shear stud or bolt (not shown) extends to releasably secure another item (e.g. a mill) to the pilot lug. Ratchet or wicker teeth 356 on the pilot lug 350 co-act with corresponding teeth on another member (e.g. teeth 386) and operate, as described above, to isolate the shear stud from a downward force applied to a member (e.g. the mill of FIG. 8A) releasably secured by the shear stud to the pilot lug 350. The lug may have the teeth 356, as may any other pilot lug or member for attaching a mill to a whipstock according to the present invention.

Figure 17A:
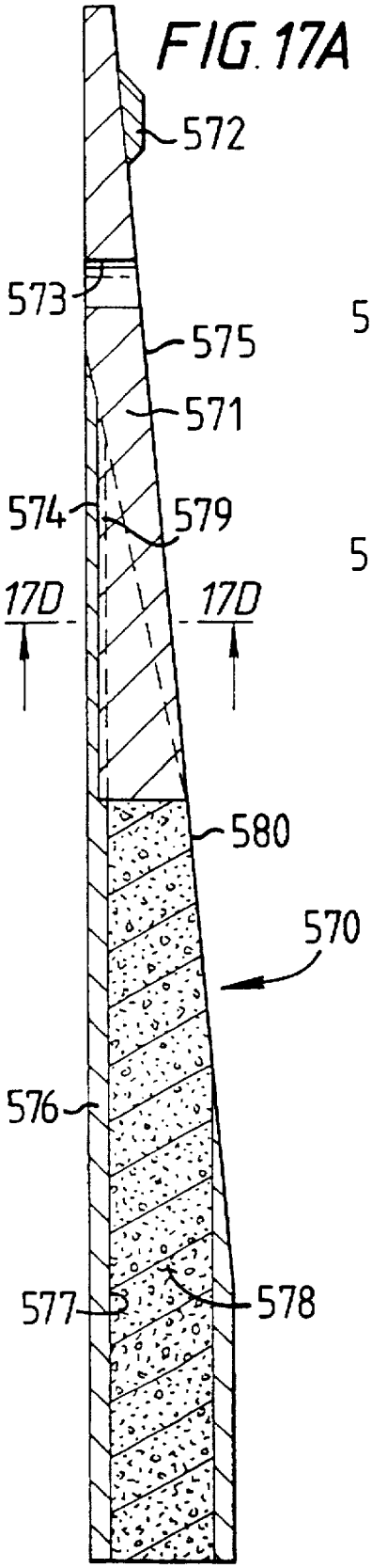
FIG. 17A is a side view in cross-section of a whipstock according to the present invention.
Figure 17B:
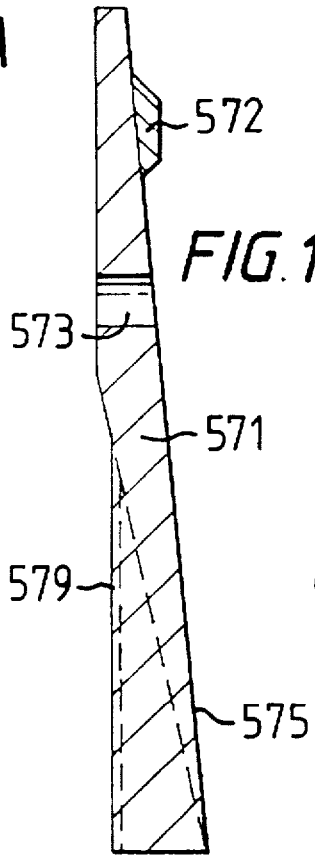
FIGS. 17B and 17C are partial views of the whipstock of FIG. 17A.
Figure 17C:
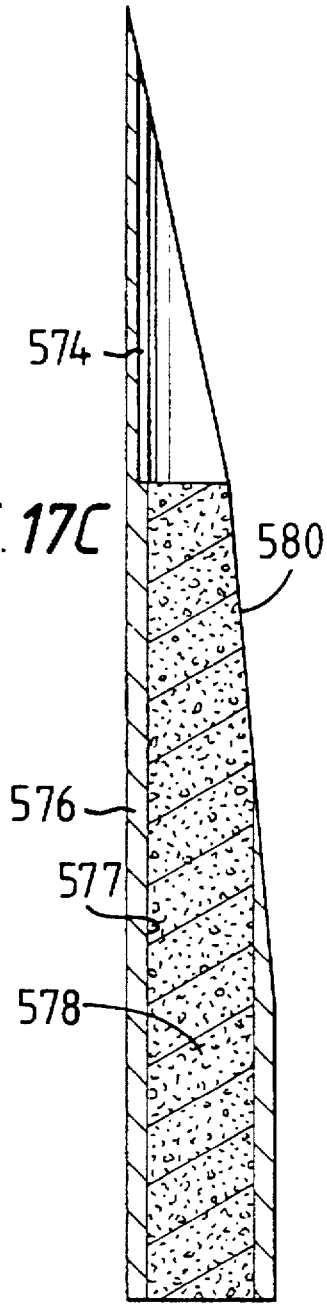
Figure 17D:
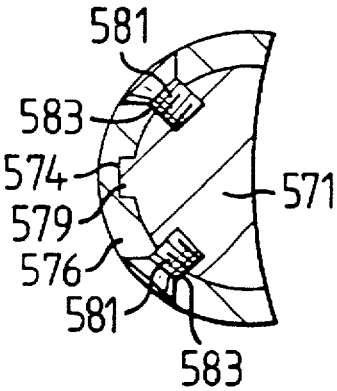
FIG. 17D is a cross-section view along line 17D—17D of FIG. 17A.

FIG. 17A–17D shows a whipstock 570 according to the present invention which has a top solid part 571 releasably connected to a hollow lower part 576. The top solid part 571 has a pilot lug 572, a retrieval hook hole 573, a concave inclined surface 575 and a rail 579. The lower hollow part 576 has an inner bore 577 shown filled with drillable filler material or cement 578. The cement is in the tool as it is inserted into the casing. The lower hollow part 576 has a concave inclined surface 580 which lines up with the concave inclined surface 575 of the top solid part 571. As shown in FIG. 17D shear screws 581 extend through holes 583 in the lower hollow part 576 and holes 582 in the top solid part 571 to releasably hold the two parts together. The rail 579 is received in a corresponding groove 574 in the lower hollow part 576 to insure correct combination of the two parts. Preferably the length of the top solid part is at least 50% of the length of the inclined portion of the concave. A whipstock 570 maybe used in any system disclosed herein. Upon completion of an operation, the top solid part is released by shearing the shear screws with an upward pull on the whipstock, making retrieval and re-use of the top solid part possible. The bottom hollow part need never leave the wellbore.

FIGS. 18A and 18B illustrate a whipstock 600 according to the present invention in a casing C in a wellbore. The whipstock 600 has an outer hollow tubular member 602 having a top end 603, a bottom end 604 and a central bore 605; and an inner solid member 606 with a top end 607, a bottom end 608, a concave 609 with a concave inclined surface 610, and a retrieval hook slot 611 in the concave 609. The hollow tubular member 602 is secured to the casing and, while in use, the inner solid member 606 is releasably secured to the outer hollow tubular member 602, e.g. by shear pins 612 extending from the inner solid member 606 into the outer hollow tubular member 602. As shown in FIG. 18B, upon shearing of the pins 612 by an upward pull with a retrieval tool T, the retrieval tool T is used to remove the inner solid member 606 for re-use.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112.

What is claimed is:

1. A whipstock comprising a body with a top and a bottom and a concave portion, the concave having a hollow portion filled with filler material, and sacrificial apparatus for guiding a mill moving down with respect to the top of the body, the sacrificial apparatus having at least one face against which a mill is movable, the sacrificial apparatus disposed for milling by the mill moving adjacent the concave portion to inhibit the mill from milling the body.

2. The whipstock of claim 1 further comprising a top of the body extending from the body above the sacrificial apparatus, a shearable member releasably connecting an upper device to the top of the body, and load isolation apparatus on the top of the body for isolating from the shearable member a load impressed through the upper device on the whipstock.

3. The whipstock of claim 1 wherein the sacrificial apparatus has a length such that the mill mills an initial window through a tubular in which the whipstock is disposed.

4. The whipstock of claim 2, the load isolation apparatus comprising the top of the body having body teeth thereon for engagement by corresponding device teeth on the upper device, the body teeth configured to transmit a downward load on the whipstock transmitted through the upper device, and the body teeth configured to slide away from the device teeth when the upper device is pulled upwardly away from the whipstock thereby shearing the shearable member.

5. A whipstock comprising a body with a top, a bottom, and a hollow concave, the hollow concave having a cavity therein filled with filler material, and a plug in the bottom of the body for maintaining the filler material in the cavity of the hollow concave.

6. The whipstock of claim 4 wherein the plug is made of readily millable material.

7. The whipstock of claim 5 wherein a fluid flow channel extends through the filler material so that fluid is flowable through the whipstock, the whipstock further comprising valve apparatus in the fluid flow channel for selectively controlling fluid flow through the whipstock.

8. The whipstock of claim 7 wherein the valve apparatus is selectively opened as the whipstock is moved down into a wellbore so fluid in the wellbore may pass through the whipstock negating buoyancy thereof.

9. The whipstock of claim 5 wherein the body has a central longitudinal axis and the plug is off-center with respect to said axis.

10. The whipstock of claim 5 further comprising positioning apparatus connected to the plug for positioning the plug in the cavity, and the plug having portions extending into the cavity having ramps so that upon milling of the plug remainders of the plug remaining in the cavity projecting thereinto present an inclined surface to an item thereafter passing through the cavity to facilitate the items passage therethrough.

11. A whipstock comprising a body with a top, a bottom, and a cavity in the body, a sacrificial element secured to the top of the body, the sacrificial element having at least one surface for abutment by a first mill moving down adjacent the whipstock to guide the first mill while the first mill mills a tubular in which the whipstock is positioned and the sacrificial element for inhibiting the mill from contacting the body, the cavity defined by sides of the body and having filler material therein, the sides of the body presenting a face for abutment by a second mill while the second mill moves down adjacent the whipstock to mill a window in the tubular, the face for guiding the second mill and inhibiting the second mill from contacting the body other than the sides thereof defining the cavity.

12. The whipstock of claim 11 further comprising the surface of the sacrificial element having a length such that the first mill moving down the surface mills through a tubular in which the whipstock is positioned while the first mill maintains contact with the surface.

13. The whipstock of claim 11 wherein the first mill has a nose projecting downwardly therefrom, the nose having a nose shape and the whipstock further comprising the sacrificial element having a groove therein with a groove shape corresponding to the nose shape of the nose of the first mill.

14. The whipstock of claim 11 wherein the sacrificial element is made of readily millable material.

15. The whipstock of claim 11 wherein the sacrificial element has a length such that the mill mills an initial window through a tubular in which the whipstock is disposed, the window at least three feet long.

16. The whipstock of claim 11 further comprising a top of the body extending from the body above the sacrificial element, a shearable member releasably connecting an upper device to the top of the body, and load isolation apparatus on the top of the body for isolating from the shearable member a load impressed through the upper device on the whipstock.

17. The whipstock of claim 11 wherein the at least one surface for abutment by a first mill of the sacrificial element includes a curved surface having a curved shape corresponding to a curved outer shape of the first mill to enhance guiding contact between the first mill and the curved surface.

18. The whipstock of claim 11 wherein the sacrificial element has a length such that a remaining portion thereof remains following production of an initial window by the first mill through the tubular, the remaining portion projecting sufficiently from the whipstock body to act as a stop member for the second mill.

19. The whipstock of claim 11 further comprising a plug in the bottom of the body for maintaining the filler material in the cavity, the plug made of readily millable material, a fluid flow channel extending through the filler material so that fluid is flowable through the whipstock, and the plug including valve apparatus in the fluid flow channel for selectively controlling fluid flow through the whipstock.

20. A whipstock comprising a body with a top, a bottom, and a cavity in the body, a sacrificial element secured to the top of the body, the sacrificial element having at least one surface for abutment by a first mill moving down adjacent the whipstock to guide the first mill while the first mill mills a tubular in which the whipstock is positioned and the sacrificial element for inhibiting the mill from contacting the body, the first mill having a curved outer shape and a nose projecting downwardly therefrom, the nose having a nose shape, the cavity defined by sides of the body and having filler material therein, the sides of the body presenting a face for abutment by a second mill while the second mill moves down adjacent the whipstock to mill a window in the tubular, the face for guiding the second mill and inhibiting the second mill from contacting the body other than the sides thereof defining the cavity, the sacrificial element having a groove therein with a groove shape corresponding to the nose shape of the nose of the first mill, the sacrificial element made of readily millable material, the at least one surface of the sacrificial element for abutment by the first mill, the at least one surface including a curved surface having a curved shape corresponding to a curved outer shape of the first mill to enhance guiding contact between the first mill and the curved surface.

* * * * *